US012122484B2

(12) United States Patent
Taylor et al.

(10) Patent No.: US 12,122,484 B2
(45) Date of Patent: Oct. 22, 2024

(54) MOORING/TENSIONING APPARATUS

(71) Applicant: FLINTSTONE TECHNOLOGY LIMITED, Dundee (GB)

(72) Inventors: Richard Taylor, Dundee (GB); David Smith, Dundee (GB)

(73) Assignee: FLINTSTONE TECHNOLOGY LIMITED, Dundee (GB)

( * ) Notice: Subject to any disclaimer, the term of this patent is extended or adjusted under 35 U.S.C. 154(b) by 400 days.

(21) Appl. No.: 17/427,425

(22) PCT Filed: Feb. 11, 2020

(86) PCT No.: PCT/GB2020/050305
§ 371 (c)(1),
(2) Date: Jul. 30, 2021

(87) PCT Pub. No.: WO2020/165568
PCT Pub. Date: Aug. 20, 2020

(65) Prior Publication Data

US 2022/0388609 A1 Dec. 8, 2022

(30) Foreign Application Priority Data

Feb. 15, 2019 (GB) ..... 1902103
Sep. 6, 2019 (GB) ..... 1912851

(51) Int. Cl.
*B63B 21/20* (2006.01)
*B63B 21/04* (2006.01)
*B63B 21/18* (2006.01)

(52) U.S. Cl.
CPC ..... *B63B 21/20* (2013.01); *B63B 21/04* (2013.01); *B63B 21/18* (2013.01); *B63B 2021/203* (2013.01)

(58) Field of Classification Search
CPC ..... B63B 21/00; B63B 21/04; B63B 21/18; B63B 21/20
(Continued)

(56) References Cited

U.S. PATENT DOCUMENTS 5,097,787 A 3/1992 Bruce
9,340,261 B2 5/2016 Macrae
(Continued)

FOREIGN PATENT DOCUMENTS

CN 1863702 A 11/2006
EP 1318072 A2 6/2003
(Continued)

OTHER PUBLICATIONS

"Combined Search and Examination Report under Sections 17 and 18(3)", UKIPO Application No. GB2111174.5, Sep. 16, 2021, 6 pp.
(Continued)

*Primary Examiner* — Lars A Olson
(74) *Attorney, Agent, or Firm* — Myers Bigel, P.A.

(57) ABSTRACT

There is disclosed an apparatus (100) for mooring a structure and/or tensioning a mooring line. The apparatus (100) comprises: a guide portion (105) for guiding a portion of a first mooring line (110), and a lock arrangement (115), wherein the apparatus (100) provides a mooring line path (120), the lock arrangement (115) being provided on an opposite side of the mooring line path (120) from the guide portion (105), at least when the lock arrangement (115) is in an unlocked configuration. When in a locked configuration at least a portion of the lock arrangement (115) is provided in the mooring path (120).

16 Claims, 33 Drawing Sheets

(58) Field of Classification Search
USPC ..... 114/230.2
See application file for complete search history.

(56) References Cited

U.S. PATENT DOCUMENTS

| | | | | |
|---|---|---|---|---|
| 10,577,056 | B2 * | 3/2020 | Lisland | B63B 21/18 |
| 11,639,214 | B2 * | 5/2023 | Remmers | B63B 21/20 114/230.2 |
| 2002/0189522 | A1 | 12/2002 | Dove et al. | |
| 2005/0241558 | A1 | 11/2005 | Barlow | |
| 2014/0216323 | A1 | 8/2014 | Macrae | |
| 2017/0297657 | A1 | 10/2017 | Busson | |
| 2017/0349243 | A1 | 12/2017 | Lisland | |

FOREIGN PATENT DOCUMENTS

| | | | |
|---|---|---|---|
| EP | 3251942 | A1 | 12/2017 |
| EP | 3251943 | A1 | 12/2017 |
| FR | 2601322 | A1 | 1/1988 |
| JP | S62241788 | A | 10/1987 |
| WO | 2018025018 | A1 | 2/2018 |
| WO | 2018197883 | A1 | 11/2018 |
| WO | 2019158905 | A1 | 8/2019 |

OTHER PUBLICATIONS

"International Search Report and Written Opinion of the International Searching Authority", International Application No. PCT/GB2020/050305, May 7, 2020, 12 pp.
"Patents Act 1977: Combined Search and Examination Report under Sections 17 and 18(3)", GB Application No. GB1912851.1, Feb. 27, 2020, 6 pp.
"Patents Act 1977: Combined Search and Examination Report under Sections 17 and 18(3)", GB Application No. GB1902103.9, Aug. 9, 2019, 8 pp.
"Patents Act 1977: Examination Report under Section 18(3)", GB Application No. GB1902103.9, Nov. 15, 2019, 5 pp.
"Communication pursuant to Article 94(3) EPC", EP Application No. 22184085.3, Sep. 29, 2023, 5 pp.
"Notice of Reasons for Refusal and English language translation", JP Application No. 2021-545967, Sep. 12, 2023, 29 pp.
"Notice of Refusal and English language translation", JP Application No. 2021-545967, Jul. 2, 2024, 6 pp.

* cited by examiner

MOORING/TENSIONING APPARATUS

RELATED APPLICATIONS

This application is a 35 U.S.C. § 371 national stage application of PCT Application No PCT/GB2020/050305 filed on Feb. 11, 2020, which claims priority from British Application No GB 1902103.9 filed on Feb. 15, 2019 and from British Application No GB 1912851.1 filed on Sep. 6, 2019, the contents of which are incorporated herein by reference in their entireties. The above-referenced PCT International Application was published as International Publication No. WO 2020/0165568 A1 on Aug. 20, 2020.

FIELD OF INVENTION

This invention relates to an apparatus or device for mooring a structure/vessel and/or tensioning a mooring line or chain, e.g. a mooring line tensioner. The invention also relates to a method of mooring a structure/vessel and/or tensioning a mooring line, and to a system for mooring a structure/vessel and/or tensioning a mooring line. The mooring line may be a mooring line for mooring a vessel or structure, such as a marine, offshore, floating or semi-submersible vessel or structure, e.g. to a seabed or bottom of a body of water.

The invention particularly, though not exclusively, relates to a mid-line, in-line or mid-water tensioner, e.g. a tensioner provided between the end of a mooring line, e.g. at a location along a length of a mooring line.

BACKGROUND TO INVENTION

Offshore structures, such as floating structures or platforms, can be moored by mooring lines, such as mooring chains. This may include attaching at least one mooring line to the structure to be moored and directly, or indirectly, coupling each mooring line to another structure, such as an anchor or pile located on a seabed. A tension may be applied to each of the mooring lines. A necessary tension can be applied to each mooring line, for example, by the use of a tensioning apparatus. The tensioning apparatus may be adapted for use by a winch, or the like. The application of tension may serve to moor the floating structure or platform in a desired position.

When an appropriate tension has been applied to a mooring line, a locking mechanism may be locked or engaged to maintain the mooring line in tension. Similarly, when a tension has to be removed from the mooring line, for example, when movement of the floating structure or platform is desired, the locking mechanism may be unlocked or disengaged.

The tensioning apparatus may be located on, or coupled to, the floating structure of platform. In such an arrangement, the mooring chain and/or tensioning apparatus may be prone to wear and/or failure due to out-of-plane stresses caused by movement of the floating structures or platforms relative to the mooring chain.

The tensioning apparatus may be located on, or coupled to, the mooring chain and may direct a free end of the mooring chain towards the surface to enable adjustment of the tension in the mooring line(s), e.g. by a winch located on a vessel.

During tensioning of the mooring line, bending strain can act on the mooring line due to the mooring line being pulled and/or bent around the tensioning apparatus. This can lead to increased wear and/or damage to the mooring chain and/or to the apparatus. In order to minimise the strain on the mooring line, the size of the tensioning apparatus may be increased to accommodate larger angles for guiding the mooring line towards the surface. However, this can lead to an increased cost and weight of the tensioning apparatus. Further, the increased weight of the tensioning apparatus also increases a loading upon the mooring chain, subsequently requiring an even greater tension to maintain a desired angle of inclination of the mooring chain.

Articulating tensioners and non-articulating tensioners are known.

An articulating tensioner allows a tensioner frame to adjust to any angle arrangement as the articulating frame moves to suit angles of the chain legs. However, the frame is complex and potentially heavier than a simple non-articulating tensioner.

A non-articulating tensioner is simpler and potentially lighter, but suffers a drawback as the relationship between the wheel pivot point, rear padeye, and lock are fixed, thus having a "sweet spot" for tensioning. If the tensioner is not at the designed angle, the chain can rub on either the upper or lower portion of a guide at the front. Chain rubbing may occur on the front guide/lock part of the frame. This rubbing can make the operation of the tensioning operation jerky—which is undesirable.

Another issue that all mid-line tensioners face is that such are effectively clump weights in the mooring line. Tensioners with locks pivoting in from the same side of the mooring line as the wheel, require that the lock be spaced far enough away from the wheel so that they do not clash. The necessary structure adds mass.

Even if one imagines a double stopper lock articulating from the side, it would still have a distance that it needed to ensure that the doors did not clash.

By flipping the stopper to the opposite side of the chain, the Inventors have found that one can pivot the stopper as close as one can get to the wheel, and even stop the chain link that is sitting on the wheel (provided the wheel and stopper are designed to mesh/interact inside the projected diameter of the wheel). The stopper can be very close to the wheel.

It may be an object of at least one embodiment of at least one aspect of the present invention to obviate or at least mitigate at least one problem in the prior art.

It may be an object of at least one embodiment of at least one aspect of the present invention to provide a technically simple and/or commercially more cost effective apparatus and/or method for mooring than in the prior art.

It may be an object of at least one embodiment of at least one aspect of the present invention to provide an apparatus, such as a mid-line tensioner, which may be improved over the prior art, e.g. being more compact, lighter and/or less expensive to manufacture.

SUMMARY OF INVENTION

First Invention

According to the present invention there is provided an apparatus or device according to the appended claims.

According to a first aspect of the present invention there is provided an (mooring) apparatus or device for mooring a structure and/or tensioning a mooring line.

The apparatus or device may comprise a guide portion or member (or sheave) for guiding a portion of a first mooring line.

The apparatus or device may comprise a lock arrangement or means

The apparatus or device may provide a mooring line path.

The lock arrangement or means may be provided or providable on an opposite side of the mooring line path from the guide portion at least in an unlocked disposition. The lock arrangement may be adapted to be provided or providable between the guide portion and a structure to be moored, in use, at least in a locked disposition, e.g. along the mooring line path.

The lock arrangement may be provided or providable between the guide portion and a structure to be moored along a path of a mooring line, for example, along the mooring line path.

The lock arrangement may be provided or providable proximal or adjacent the guide portion.

The apparatus or device may comprise a body or "frame".

The body may comprise an arrangement for connecting or coupling, e.g. directly connecting or coupling, the apparatus or device to a second mooring line.

The apparatus or device may be adapted for use with a mooring line comprising a mooring chain.

In use, a locked link of a/the mooring chain may be provided between and/or engaged with one or both of the guide portion and the lock arrangement.

The lock arrangement may comprise a lock member or pawl.

The lock member may comprise a pin or a yoke. The guide portion may comprise a wheel having a circumferential groove or circumferential teeth.

When in a locked disposition a face, e.g. lock face, e.g. adjacent a/the locked link, of the lock member may face the arrangement for connecting the apparatus to the second mooring line.

A part or point, e.g. peripheral or circumferential part or point, of the guide portion may be provided between the second mooring line connection arrangement and the lock arrangement/member when in a locked disposition.

The guide portion may be circular and/or comprise a wheel.

In a locked disposition a tangent or tangential line of or extending from a portion (circumferential portion) the guide portion may pass through the lock arrangement or member and the second mooring line connection arrangement.

The tangent or tangential line may touch the guide portion at a point at or adjacent the lock arrangement or member, at least when in a locked disposition.

By this arrangement there may be provided, in use, a linear load path comprising a (linear) portion of the first mooring line path or tensioned portion of a first mooring line, the tangent or tangential line of the guide portion, and a (linear) portion of a second mooring line path or path of a second mooring line.

Advantageously by this arrangement no load may be taken around the guide portion or around a curved portion of the first mooring line portion.

Tension on the first mooring line may, therefore, be taken at or near a contact point with the guide portion and not around the guide portion.

A radius of the guide portion extending perpendicularly to a line (or the tangential line) extending between the second mooring line connection arrangement and the lock arrangement/lock member, (at least when in a locked disposition) may intersect said line at a location between the second mooring line connection arrangement and the lock arrangement/member.

In other words, the load member (stopper) is beneficially in front of the guide wheel along a tensioned/tensionable portion of the first mooring line portion.

An advantage of having the lock arrangement in front of the guide portion may be that the guide portion is not exposed to load. Loaded wheels on fairleads are known to cause additional stresses in mooring chains. In the present invention a load is transmitted through the lock arrangement rather than through the mooring guide portion.

The lock arrangement may be provided so that a portion of the lock arrangement operates inside a projected footprint (diameter) of the movable guide portion (i.e. wheel). The lock arrangement may operate/pivot/articulate from an opposite side of the first mooring line portion to the movable guide portion or adjacent an intended mooring line contact point with the guide portion (e.g. a tangent point of the incoming tensioning chain). This may ensure that a bulk of a load may be transmitted to the lock arrangement and not into the guide portion. Such may also allow the incoming chain direct contact with the movable guide portion on entry to create a smooth entry in most conditions. The movable guide portion (wheel), chain and lock arrangement are designed to mesh, overlap or interact, in use.

The guide portion and lock arrangement/lock member may act as or comprise a ratchet mechanism.

A tensioning side of the lock member or ratchet may extend around the guide portion. A tensionable/tensioned side of the lock member may extend away from the guide portion.

In a locked configuration, a locked link and/or a first loaded link, may be provided in a linear arrangement with the lock member and tangential line from the guide portion, e.g. along a linear load path.

The lock arrangement may comprise a counterweight, which may be formed with, connected to, or releasably connectable to the lock member.

The guide portion and lock member may be configured such that, in use, a locked link engages or abuts with the guide portion.

The locked link may (also) engage or abut with the lock arrangement/member/lock face of the lock member.

The aforementioned configuration may allow a first (axially) loaded link to be disposed, in use, to be substantially tangential to the guide portion, e.g. on a/the tangential line.

The first mooring line path may comprise a first lockable or locked or tensioned/tensionable portion, e.g. extending (linearly) from the tangential line contact point on the guide portion, e.g. away from the mooring apparatus.

The first mooring line path may comprise a second free, pullable or tensioning portion or end, e.g. extending from the tangential line contact point on the guide portion, e.g. at least partially around the guide portion.

When in an open or unlocked disposition, the lock member or lock face may be on an external angle of the first mooring line path and/or on an opposite side of the mooring line path from the guide portion.

When in a closed or locked disposition at least part of the lock member or lock face may be in or on the first mooring line path and/or may face the second mooring line connection arrangement.

A pivot (point) of the lock arrangement or lock member may be on the exterior angle or opposite side of the first mooring line path than the guide portion.

The apparatus or device of the present invention may provide for a lock arrangement which is significantly closer to the guide portion than in the prior art. This may result in one or more advantages, e.g. reduced length, reduced weight, and/or reduced cost of the apparatus or device.

The apparatus or device of the present invention may also provide advantage over one or more prior art apparatus in that, in use, the mooring line around the guide portion is not under tension when the structure is moored since tension is taken by the lock arrangement.

The mooring line path may comprise or include a curved path.

The mooring line path may comprise an included or interior angle $\alpha$ and an excluded or exterior angle $\beta$.

The guide portion may be provided on or within the interior angle $\alpha$ of the mooring path.

The lock arrangement or means may be provided on or within the exterior angle $\beta$ of the mooring line path, at least in an unlocked disposition.

The present invention may provide an advantage over the prior art in that the lock arrangement or means may be provided on or outside of the included angle of the mooring line path, e.g. underneath or below the apparatus or device. This may be beneficial in allowing access to the lock arrangement or means.

The present invention may provide an advantage over the prior art in that, in use, the lock arrangement may grasp or tensions the first mooring line prior to the first mooring line extending around the guide portion. The first mooring line may, therefore, not be under tension around the guide portion.

The apparatus or device may comprise a body or frame.

The guide portion may be movably, e.g. rotatably, mounted on (or relative to) the body.

The lock arrangement or means may comprise a lock member, e.g. having a lock face or side. In a first, unlocked, disposition the lock member may be distal or non-coincident with the mooring line path. In a second, locked, disposition at least part of the lock member may be coincident with the mooring line path. For example, in said second disposition, an end of the lock member may engage with the mooring line, e.g. with a link of a mooring line comprising a mooring chain.

The lock member may be connected to or provided on the body, e.g. pivotably attached to the body. A pivot point of the lock member may be on an opposite side of the mooring line path than the guide portion.

The end of the lock member may be closer to a structure to be moored when in the second locked disposition than when in the first, unlocked, disposition.

The body may comprise an arrangement for connecting or coupling, e.g. directly connecting or coupling, the apparatus or device to a second mooring line.

The connection arrangement may be provided on the body.

The apparatus or device may comprise or be referenced as a "mid-line tensioner".

The guide portion may comprise a circular member or wheel. The guide portion may comprise a plurality of circumferentially disposed teeth and/or a circumferential groove or recess, which may, in use, co-act with a/the end of the lock member, for example, so as to lock a/the mooring line relative to the apparatus or device when the lock member is in the second locked disposition.

The lock arrangement may be conveniently referred to as a 'chain stopper'.

The guide portion may comprise first and second sides, which may be circular, and which may comprise respective first and second teeth, pairs of which may be circumferentially aligned, for example, face one another.

At least a portion of the mooring line path may be provided between the first and second sides of the guide portion.

The body may comprise a guide arrangement for guiding a portion of a mooring line, for example, into or out of the apparatus or device. In one implementation the guide arrangement may comprise a pair of opposing guide members. In an alternative implementation the guide arrangement may comprise an open channel for guiding and/or seating the first mooring line.

The lock arrangement may be provided or providable between the guide portion and the guide arrangement.

In use, when tension is applied to an end of a mooring line distal a structure to be moored or on an opposite side of the apparatus or device from a structure, the lock member will tend towards or be disposed in the first, unlocked, disposition.

In use, when tension is removed from an end of a mooring line distal a structure or an opposite side of the apparatus or device from a structure, the lock member will tend towards or be disposed in the second, unlocked, disposition.

By this apparatus a (first) mooring line may be tensioned.

The lock arrangement may comprise a mooring line lock, e.g. capable of locking or retaining the first mooring line.

In use, at least a portion of the first mooring line may be disposed, locked and/or secured by the lock arrangement. The at least a portion of the first mooring line may comprise a locked link. A link adjacent the locked link in a direction away from the guide portion may comprise a first loaded link.

The lock may be adapted to secure and/or lock the first mooring line between the lock arrangement and a portion, e.g. an outer peripheral/circumferential portion, of the guide portion.

The guide portion may be rotatably connected to the body, e.g. on or around an axis.

The lock arrangement may be hingedly or pivotably connected to the body.

Beneficially least a portion of at least one or both of the mooring lines may be a chain, or alternatively wire, rope, or the like. At least a portion of the first mooring line may be a first chain. At least a portion of the second mooring line may be a second chain.

The guide portion may be a sheave or wheel and/or may be substantially circular, such as a mooring line wheel or a chain wheel which may be rotatable relative to the body, such as around a central axis of the guide portion. The guide portion may be a sprag wheel. The guide portion may be a sheave. The guide portion may be a toothed wheel, such as a cogwheel or the like.

According to a second aspect of the present invention there is provided an (mooring) apparatus or device for mooring a structure, the apparatus or device comprising:

- a body;
- a guide portion for guiding a portion of a first mooring line; and
- a lock arrangement or means, wherein
- the guide portion is provided on and/or within a first side or end of the body, and the lock arrangement or means is provided on and/or within a second side or end of the body, which second side or end may at least partly oppose the first side or end.

The apparatus or device may provide a mooring line path. The lock arrangement or means may be provided on an opposite side of the mooring line path from the guide portion (at least in an unlocked disposition). The lock arrangement may be (adapted to be) provided between the guide portion and a structure to be moored, in use (at least in a locked disposition).

According to a third aspect of the present invention there is provided an (mooring) apparatus or device for mooring a structure, the apparatus or device comprising:

a guide portion for guiding a portion of a first mooring line; and a lock arrangement or means, wherein the apparatus or device provides a mooring line path having an included angle, the lock arrangement being provided on an opposite side of the mooring line path from the included angle and between the guide portion and a structure to be moored, in use.

The guide portion may be provided on the side of or within the included angle.

According to fourth aspect of the present invention there is provided an apparatus or device for mooring a structure and/or tensioning a mooring line, the apparatus comprising:

a body or frame:

a guide portion for guiding a portion of a first mooring line, the guide portion being rotationally mounted on the body;

a lock arrangement comprising a lock member movable between an unlocked position and a locked position (and a locked position and an unlocked position);

the body comprising an arrangement for connecting the apparatus to a second mooring line; and the apparatus providing a first mooring line path, the lock member being provided on an opposite side of the first mooring line path from the guide portion when in an unlocked position, and the lock member being at least partially provided in or on the first mooring line path when in a locked position, and wherein, in use, a locked link of a mooring chain is providable between and/or engaged with one or both of the guide portion and the lock arrangement, and when in a locked position a lock face of the lock member faces the arrangement for connecting the apparatus to the second mooring line.

According to a fifth aspect of the present invention there is provided an apparatus or device for mooring a structure and/or tensioning a morning line, the apparatus comprising:

a body or frame:

a guide portion for guiding a portion of a first mooring line, the guide portion being rotationally mounted on the body;

a lock arrangement comprising a lock member movable between an unlocked position and a locked position (and a locked position and an unlocked position);

the body comprising an arrangement for connecting the apparatus to a second mooring line; and the apparatus providing a first mooring line path, the lock member being provided on an opposite side of the first mooring line path from the guide portion when in an unlocked position, and the lock member being at least partially provided in or on the first mooring line path when in a lock position, and wherein in a locked position a tangent or tangential line of or extending from a portion of the guide position passes through the lock member and the second mooring line connection arrangement.

According to a sixth aspect of the present invention there is provided a system for tensioning a (first) mooring line, the system comprising at least one mooring and/or tensioning apparatus according to any of the first to fifth aspects of the present invention.

The system may comprise a first mooring line or chain. The system may comprise a second mooring line or chain.

The system may comprise at least one structure, such as a floating structure, an offshore structure, a floating platform or the like.

A portion of the first mooring line may be threaded or threadable through the apparatus or device.

A first portion or end of the first mooring line may be configured to be connected or connectable to the structure or device.

The system may comprise a buoy. The system may comprise a floating vessel. The system may comprise a winch and/or a pulley. The winch and/or pulley may be located on or in the floating vessel. The buoy may be a submersible buoy, a semi-submersible buoy, a submerged turret production buoy, a submerged turret loading buoy or the like.

A second portion or end of the first mooring line may be configured to be connected to the buoy and/or the floating vessel and/or the winch and/or the pulley. The winch and/or pulley may be adapted to set, adjust or increase a tension in the first mooring line.

A first portion or end of the second mooring line may be connected to at least a portion of the apparatus. The first portion or end of the second mooring line may be connected to the body. The first portion of the second mooring line may be releasably connected to the body.

The system may comprise an anchor. The anchor may comprise an anchoring point. The anchor may be a pile, such as a suction pile or the like. The anchor may be a subsea formation. The anchor may be adapted for use on a seabed.

A second portion of the second mooring line may be connected to the anchor or to the anchoring point.

According to a seventh aspect of the present invention there is provided a method of tensioning a (first) mooring line, wherein the method comprises:

providing a system for tensioning a (first) mooring line according to the sixth aspect of the present invention, the method (further) comprising:

applying a pulling force to a first portion of a first mooring line in a direction away from the apparatus or device.

The pulling force may cause the apparatus or device to pull at least one other portion of the first mooring line towards a second mooring line.

The pulling force may cause the apparatus or device to pull at least one other portion of the first mooring line towards the apparatus.

When an appropriate or desired tension has been applied to the mooring line, the lock arrangement may be disposed in the locked position.

When an appropriate or desired tension has been applied to the mooring line, the first portion or end of the first mooring line may be attached to a buoy, or the like.

When an appropriate tension has been applied to the mooring line, at least a portion of the first portion of the first mooring line may be cut away and/or removed and/or secured to the apparatus or device and/or secured to the first and/or second mooring lines.

According to an eighth aspect of the present invention there is provided a method for releasing tension in a mooring line, the method comprising:

providing a system for tensioning a mooring line according to the sixth aspect of the present invention, the method (further) comprising:

applying a pulling force to a/the first portion of a/the first mooring line in a direction away from the apparatus or device;

releasing the lock from a locked disposition and/or retaining the lock arrangement in an unlocked disposition; and reducing and/or removing the pulling force.

The step of retaining the lock arrangement in the unlocked disposition may require removal and/or repositioning and/or insertion of at least one locking pin.

Second Invention

According to a ninth aspect of the present invention there is provided an apparatus or device for mooring a structure, the apparatus or device comprising:

a body and a guide portion for guiding at least a portion of a first mooring line along a mooring line path; wherein the body comprises an open channel for guiding and/or seating a/the first mooring line.

The open channel may comprise a partial-cruciform or half-cruciform shaped surface.

The open channel may comprise a first U-shaped or D-shaped surface, with a second, smaller D-shaped or U-shaped surface disposed at a mid-point of the first U-shaped or D-shaped surface.

The open channel may comprise a first cupped or cup-shaped surface, with a second, smaller cup-shaped or cupped, D-shaped or U-shaped surface disposed at a mid-point of the first cupped or cup-shaped surface.

That is, the open channel may comprise a substantially recessed or concave first portion, with a second, recessed portion disposed at a mid-point of the first portion. The open channel may comprise a substantially recessed or concave first portion, with a second, deeper recessed portion disposed at a mid-point of the first portion.

The open channel may comprise a first trough, with a second smaller trough disposed at a mid-point of a deepest portion of the first trough. The open channel may comprise a first trough, with a second smaller trough disposed at a deepest portion of the first trough.

A cross-section of the open channel may be substantially T-shaped.

The partial-cruciform or half-cruciform shaped surface may be shaped and sized to conform to at least a portion of the first mooring line, e.g. shaped and sized to conform to a mooring line or chain.

The partial-cruciform or half-cruciform shaped surface may be configured to seat the mooring line.

A surface of the open channel, or the partial-cruciform or half-cruciform shaped surface, may be configured to inhibit pivoting of the mooring line relative to the body in a first direction perpendicular to the mooring line path and away from the guide portion.

The open channel may be provided to allow pivoting of the mooring line relative to the body between a/the surface of the open channel and the guide portion.

The open channel may comprise sidewalls configured to inhibit pivoting of the mooring line in a third direction, the third direction being perpendicular to the mooring line path and the first direction.

The open channel may be located or disposed at or adjacent a periphery of the body.

The open channel may be located or disposed at an entry and/or exit point of or from the apparatus.

The entry and/or exit point may be an entry and/or exit point of the mooring line, e.g. an entry and/or exit point of the mooring line relative to the body.

The open channel may be provided between the guide portion and a structure to be moored, in use.

The body may comprise a connection portion for connecting the apparatus or device to a second mooring line. The guide portion may be disposed between the connection portion and the open channel.

The connection portion may be disposed on the body such that, during tensioning of the first and/or second mooring lines, the first mooring line moves or pivots relative to the body in response to a tilting or rotation of the body. The movement or pivoting of the first mooring line relative to the body may be movement or pivoting between a/the surface of the open channel and the guide portion.

In use, the first mooring line may be free to move or pivot in the open channel, relative to the body.

The connection portion may be disposed on the body such that, during tensioning of the mooring lines, the body tends to tilt or rotate to align a line between a centre of the guide portion and the connection portion with the second mooring line.

The connection portion may comprise a pad-eye, shackle or clevis.

The apparatus may comprise a lock arrangement or means.

The lock arrangement or means may be adapted to engage the first mooring line to inhibit movement of the mooring line relative to the body in a direction along the mooring line path and allow movement of the mooring line relative to the body in an opposite direction along the mooring line path.

The lock arrangement or means may be provided on an opposite side of the mooring line path from the guide portion.

The lock arrangement or means may be adapted to be provided between the guide portion and a structure to be moored, in use.

The lock arrangement may be provided between the guide portion and a structure to be moored along a path of a mooring line, for example, along the mooring line path.

The lock arrangement may be provided proximal or adjacent the guide portion.

The apparatus or device of the present invention may provide for a lock arrangement which is significantly closer to the guide portion than in the prior art. This may result in one or more advantages, e.g. reduced length, reduced weight, and/or reduced cost of the apparatus or device.

The lock arrangement or means may be configurable to straddle the guide portion.

The lock arrangement may comprise a yoke. The yoke may be configured to straddle the guide portion. The yoke may be configured to straddle the first mooring line, e.g. the first mooring line.

The lock arrangement may comprise a finger. The finger may be configured to interfere with, such as abut, the guide portion. The finger may be configured to interfere with, such as abut, the mooring line, e.g. the first mooring line.

The lock arrangement or means may be configurable to straddle the first mooring line.

The lock arrangement or means may comprise a lock member. In a first, unlocked, disposition the lock member may be distal or non-coincident with the mooring line path. In a second, locked, disposition at least part of the lock member may be coincident with the mooring line path. For example, in said second disposition, an end of the lock member may engage with the (first) mooring line, e.g. with a link of a mooring line comprising a mooring chain.

The lock member may be connected to or provided on the body, e.g. pivotably attached to the body.

A/the end of the lock member may be closer to a structure to be moored when in the second locked disposition than when in the first, unlocked, disposition.

The lock arrangement or means may comprise a pivotable member or clacker. The lock member may be a pivotable member or clacker.

The lock arrangement or means may comprise a counterweight, e.g. removable counterweight, for biasing the lock arrangement or means or the pivotable member or clacker towards engagement with the first mooring line.

A point of rotation of the pivotable member or clacker may be provided on the opposite side of the mooring line path from the guide portion.

The lock arrangement or means may be adapted to hold or seat the mooring line between the guide portion and the pivotable member or clacker.

In use, at least a portion of the first mooring line may be disposed between the lock arrangement or means and the guide portion.

The mooring line path may comprise a curved path.

The mooring line path may comprise an included or interior angle $\alpha$ and an excluded or exterior angle R.

The guide portion may be provided on or within the interior angle $\alpha$ of the mooring path.

The lock arrangement or means may be provided, e.g. in a first (unlocked) disposition, on or within the exterior angle $\beta$ of the mooring line path.

The guide portion may be movably, e.g. rotatably, mounted on the body.

The guide portion may comprise a chain wheel, a sprocket or a pocket wheel. The guide portion may be substantially circular, such as a mooring line wheel or a chain wheel which is rotatable relative to the body, such as around a central axis of the guide portion. The guide portion may be a sprag wheel. The guide portion may be a sheave. The guide portion may be a toothed wheel, such as a cogwheel, or the like.

The apparatus or device may be suitable for offshore and/or subsea operations and may be submerged, in use. By this apparatus a (first) mooring line may be tensioned.

The apparatus may be known as and/or referred to as a "mid-line tensioner" and/or "inline tensioner".

The apparatus may be a mid-line tensioner.

The lock arrangement may comprise a mooring line lock, e.g. capable of locking or retaining the first mooring line.

In use, at least a portion of the first mooring line may be disposed, locked and/or secured by the lock arrangement.

The lock may be adapted to secure and/or lock the first mooring line between the lock arrangement and an outer peripheral/circumferential portion of body.

The guide portion may be rotatably connected to the body, e.g. on or around an axis.

The lock arrangement may be hingedly or pivotably connected to the body.

At least a portion of at least one or both of the mooring lines may be a chain, wire, rope, or the like. At least a portion of the first mooring line may be a first chain. At least a portion of the second mooring line may be a second chain.

According to an aspect of the present invention, there is provided an apparatus or device for mooring a structure, the apparatus or device comprising: a body and a guide portion for guiding at least a portion of a first mooring line along a mooring line path; a connection portion for connecting the body to a second mooring line; wherein during tensioning of the mooring lines, the apparatus or device is configured to permit movement or pivoting of the first mooring line relative to the body into a space or gap between the guide portion and the body, in response to a tilting or rotation of the body.

According to a tenth aspect of the present invention there is provided an apparatus or device for mooring a structure, the apparatus or device comprising: a body and a guide portion for guiding at least a portion of a first mooring line along a mooring line path; a connection portion for connecting the body to a second mooring line; wherein the connection portion is disposed on the body such that, during tensioning of the mooring lines, the body tends to tilt or rotate to align a line between a centre of the guide portion and the connection portion with the second mooring line.

According to a eleventh aspect of the present invention there is provided an apparatus or device for mooring a structure, the apparatus or device comprising: a guide portion for guiding at least a portion of a first mooring line; a lock arrangement or means adapted to engage the first mooring line; wherein the guide portion is adapted to engage the first mooring line, and wherein the lock arrangement is configurable to straddle the guide portion and/or the first mooring line.

According to a twelfth aspect of the present invention, there is provided a (mooring) system for tensioning a first mooring line, the system comprising at least one device or apparatus according to the ninth, tenth or eleventh aspects, the first mooring line, and a second mooring line.

The first mooring line may be a chain and the open channel may be shaped and sized to conform to a longitudinally cross-sectional view of the first mooring line.

The system may moor or may comprise at least one structure, such as a floating structure, an offshore structure, a floating platform or the like.

According to a thirteenth aspect of the present invention there is provided a method for tensioning a mooring line, the method comprising: providing a system for tensioning a mooring line according to the twelfth aspect, the method further comprising: applying a pulling force to a/the first portion of a/the first mooring line in a direction away from the apparatus or device.

It should be understood that the features defined above in accordance with any aspect of the present invention or below relating to any specific embodiment of the invention may be utilised, either alone or in combination with any other feature of or defined in any other aspect or embodiment, e.g. so as to form a further aspect or embodiment of the present invention. Such further combinations are not recited herein merely for reasons of brevity.

BRIEF DESCRIPTION OF DRAWINGS

Embodiments of the present invention will now be described by way of example only, and with reference to the accompanying drawings, which are.

DETAILED DESCRIPTION OF DRAWINGS

Figure 1:
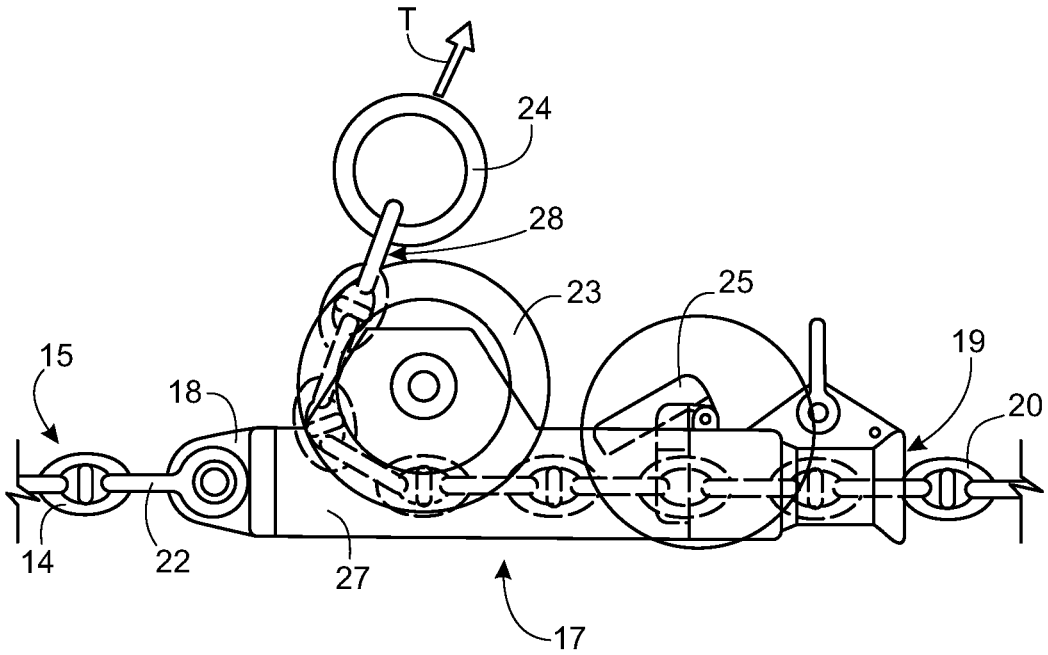
FIG. 1 a side view of a first mooring apparatus according to the prior art.

Referring initially to FIG. 1, there is shown a chain tensioner generally designated 17, according to the prior art as disclosed in US 2014/0216323 A1 (SINGLE BUOY MOORINGS). As shown in FIG. 1, a chain tensioner 17 is fixedly attached with a connection side 18 to an upper end of chain section 15 via a chain link 14 and connector member, such as a bow shackle 22. Instead of chain section 15, a wire rope or other line section is utilised to connect to side 18 of the chain tensioner device 17 using a suitable connector member. During connection of the upper end of chain section 15 to the chain tensioner device 17, the chain section 15 remains clamped on deck of the vessel. A working chain 20 having a length of for instance 200 metres, is on deck of a vessel movably passed through the chain tensioner 17 by feeding tensioning chain section 28 that is formed by the lower part of the working chain 20 via an entry side 19 of the chain tensioner 17 through a chain stopper 25 and along a sheave 23. The chain stopper 25 functions as a ratchet and only allows passage of the working chain 20 through the tensioner housing 27 in the direction of the shorter tensioning chain part 28 that becomes longer upon pulling it in the direction indicated as T. The tensioning chain part 28 of the tensioning chain 20 is guided via the rotatable sheave 23 out through an opening 26 in the housing 27 of the chain tensioner 17. A pulling eye 24 of relatively large diameter is attached to tensioner chain part 28 for handling by a remote operated vehicle (ROV).

Figure 2:
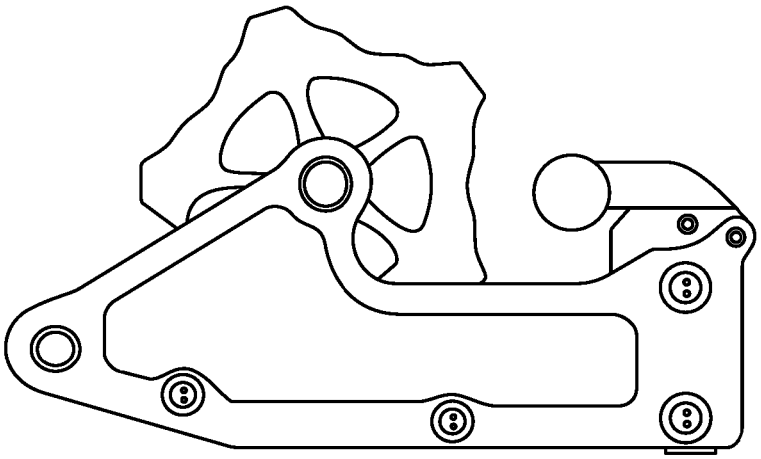
FIG. 2 a side view of a second mooring apparatus according to the prior art.
Figure 3:
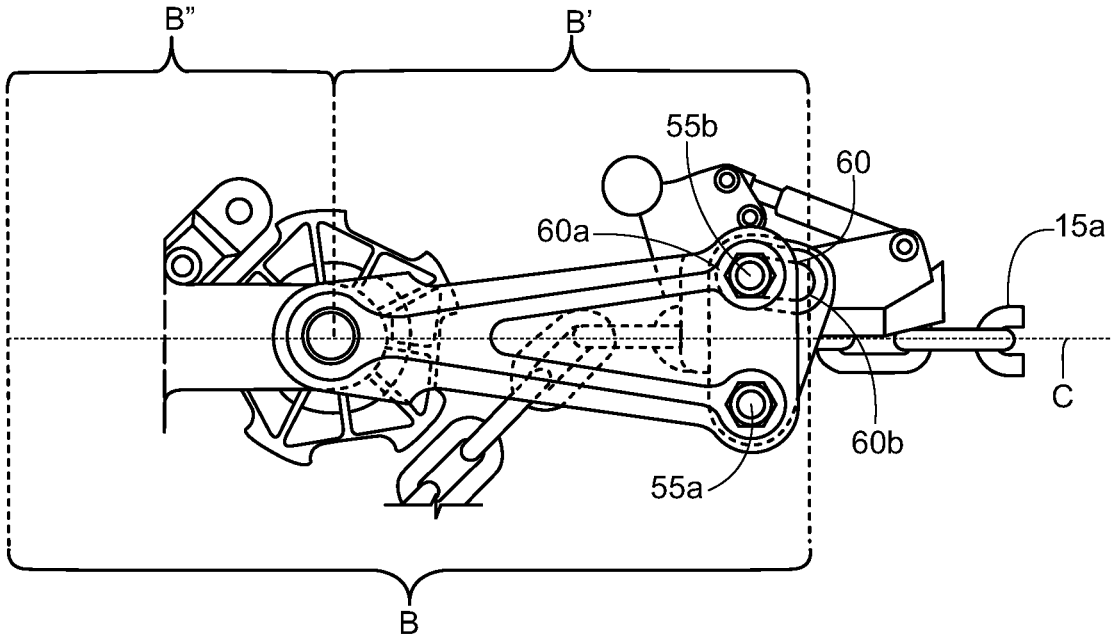
FIG. 3 a side view of a third mooring apparatus according to the prior art.
Figure 4:
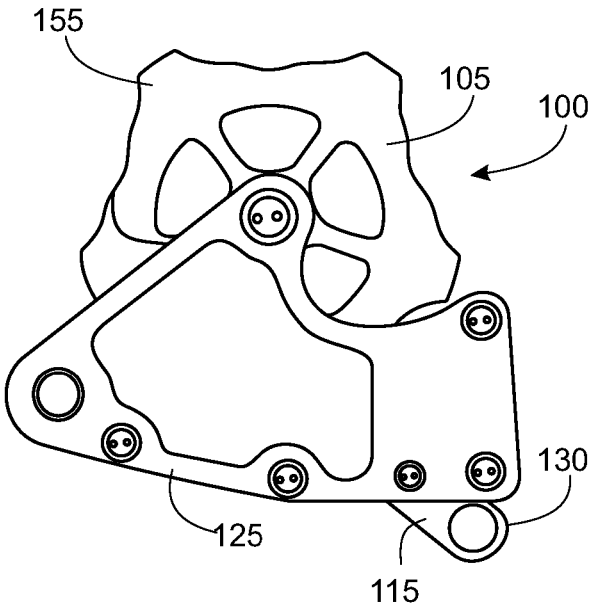
FIG. 4 a side view of a mooring apparatus or device according to an embodiment of the present invention.
Figure 5:
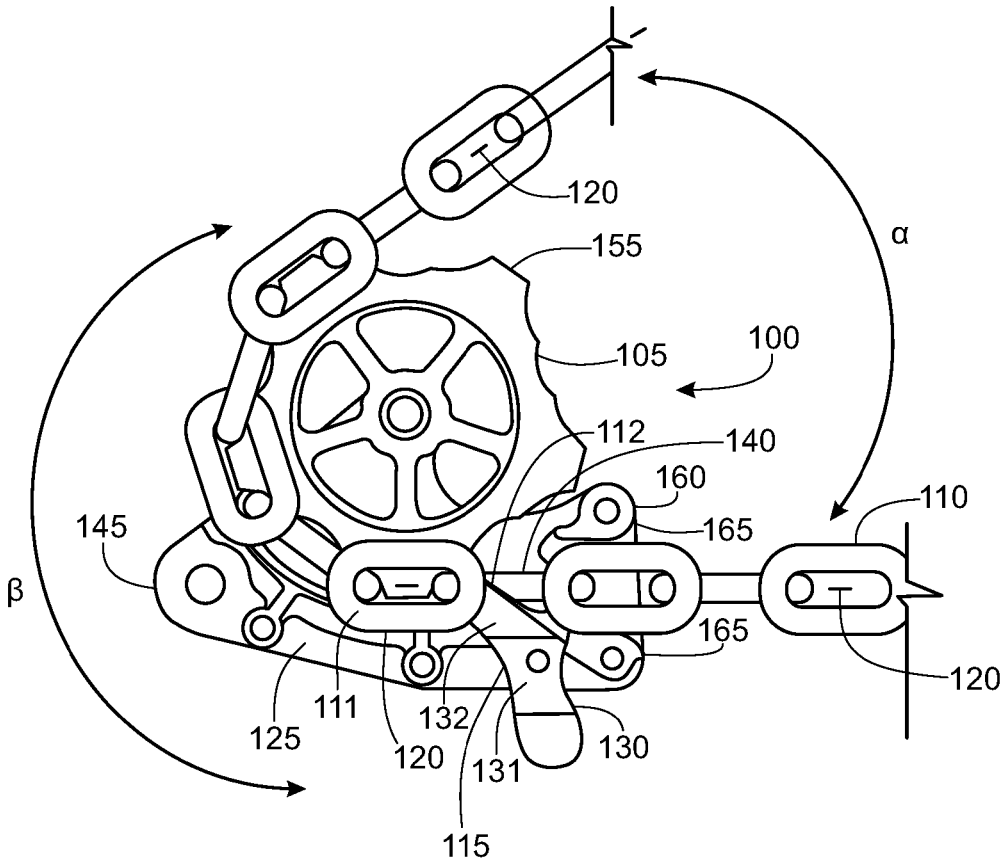
FIG. 5 a sectional side view of the mooring apparatus of FIG. 4 with a first mooring line in situ.
Figure 6:
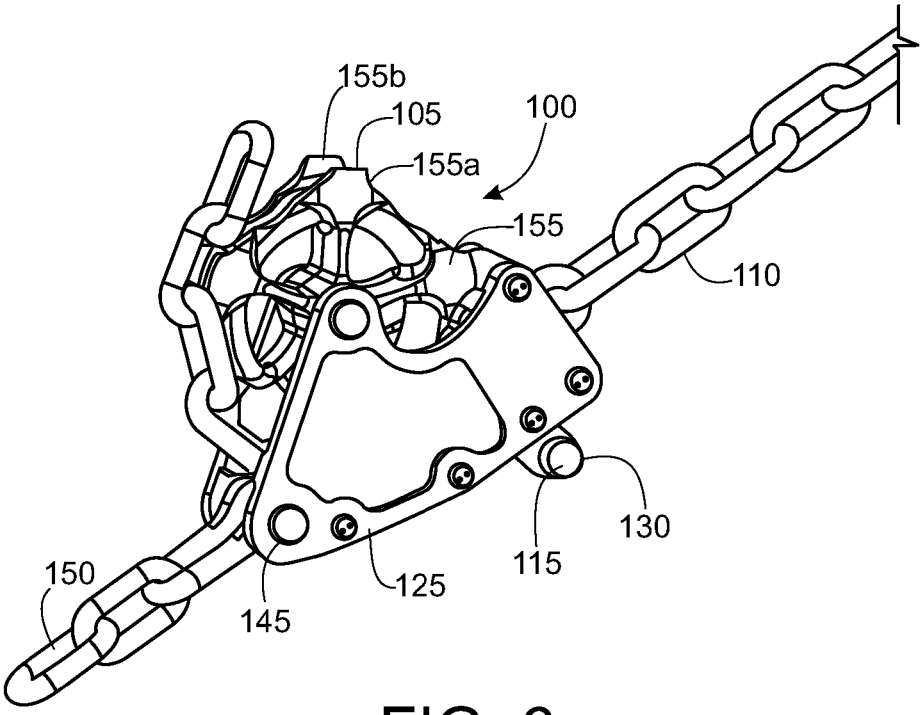
FIG. 6 a perspective view from above and to one side of the mooring apparatus of FIG. 4.
Figure 7:
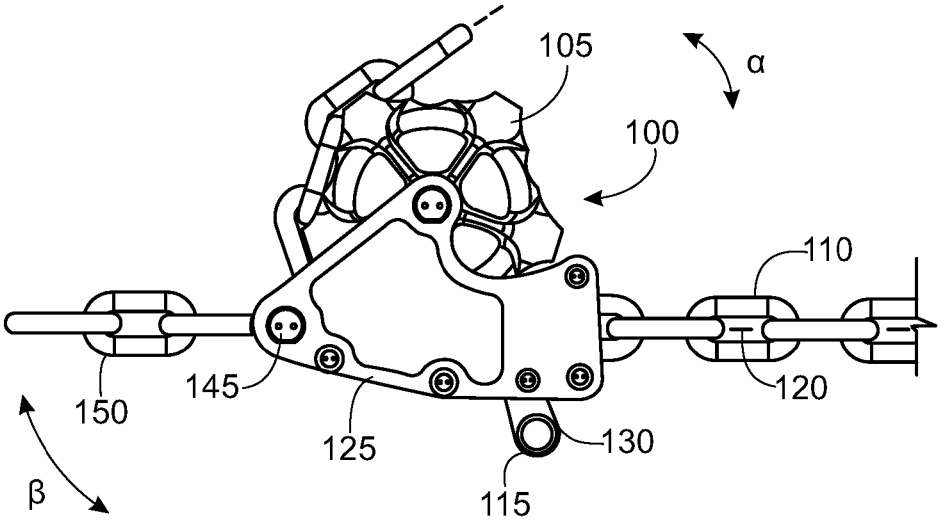
FIG. 7 a side view of the mooring apparatus of FIG. 4 with first and second mooring lines in situ.
Figure 8:
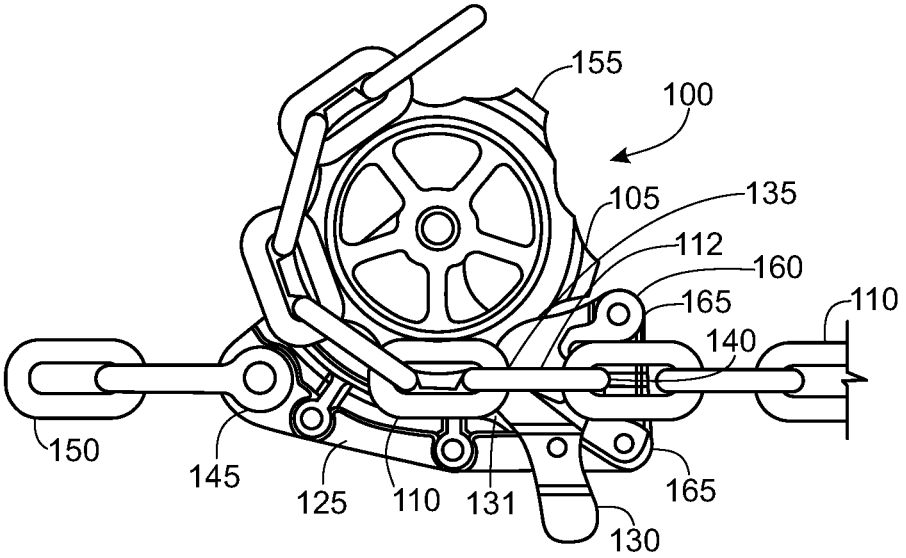
FIG. 8 a sectional side view of the mooring apparatus of FIG. 4 with first and second mooring lines in situ.
Figure 9:
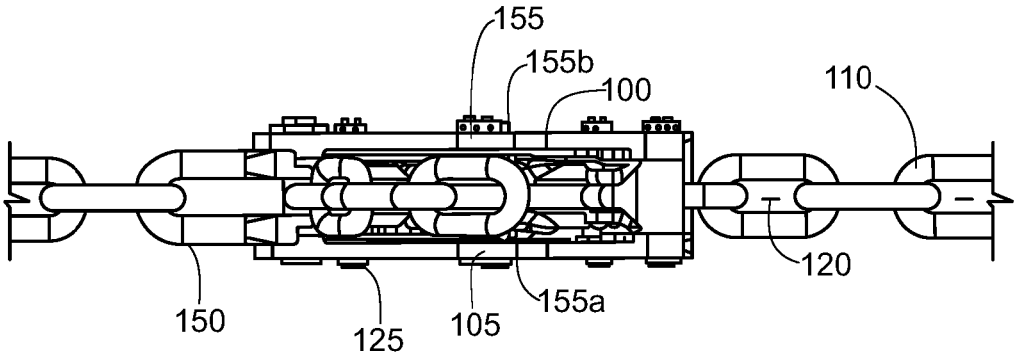
FIG. 9 a top view of the mooring apparatus of FIG. 4 with first and second mooring line in situ.
Figure 10:
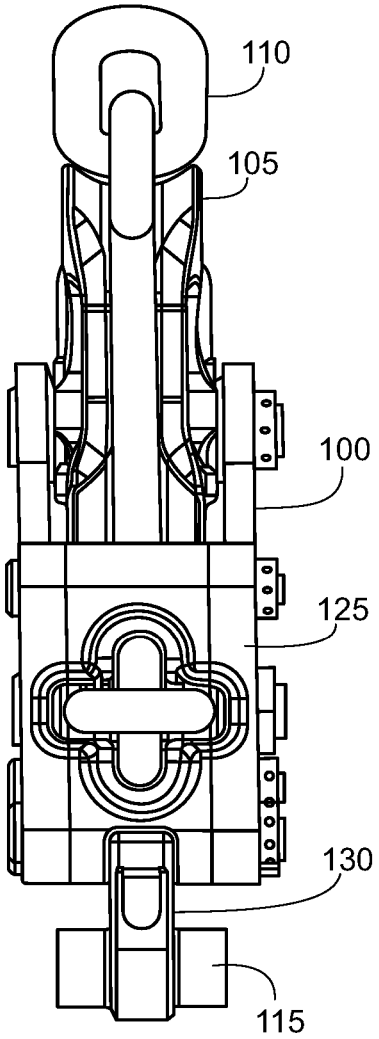
FIG. 10 an end view of the mooring apparatus of FIG. 4 with a first mooring line in situ.
Figure 11:
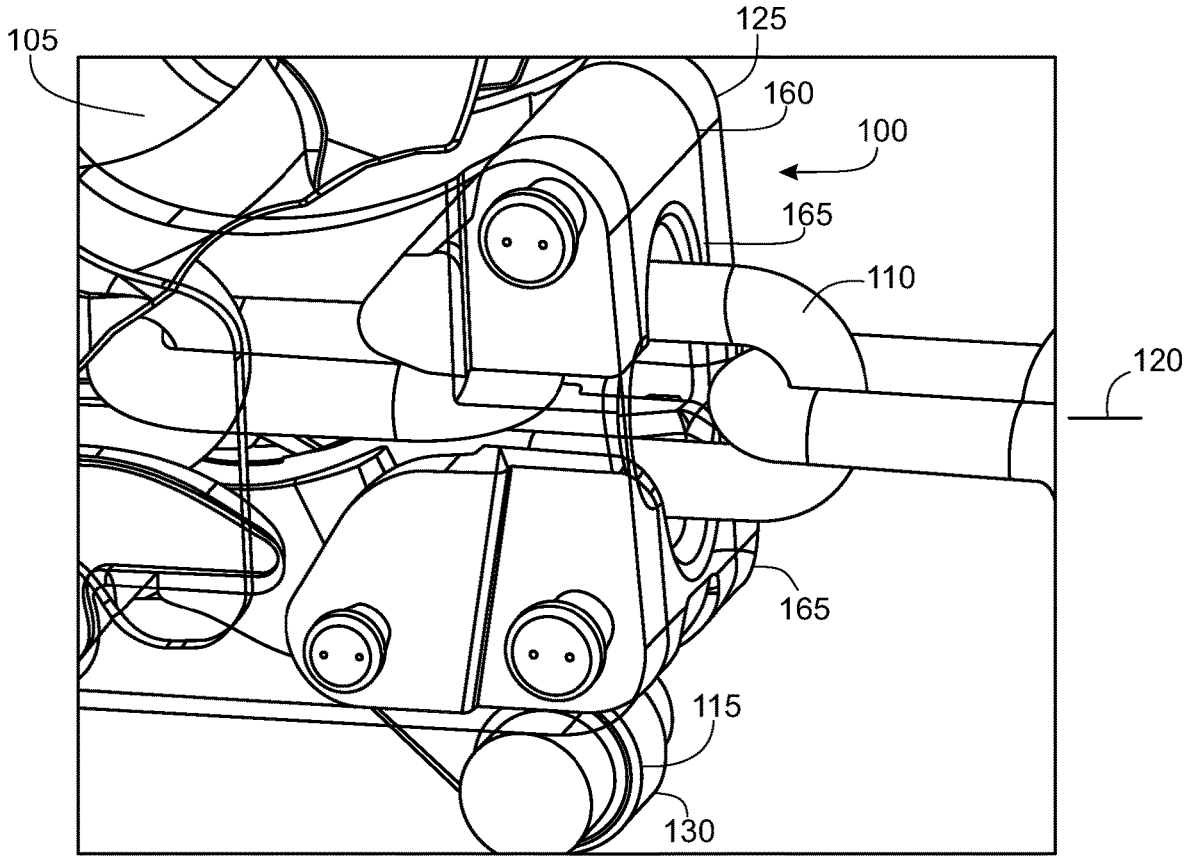
FIG. 11 a sectional partial side view to an enlarged scale of the mooring apparatus of FIG. 4.
Figure 12:
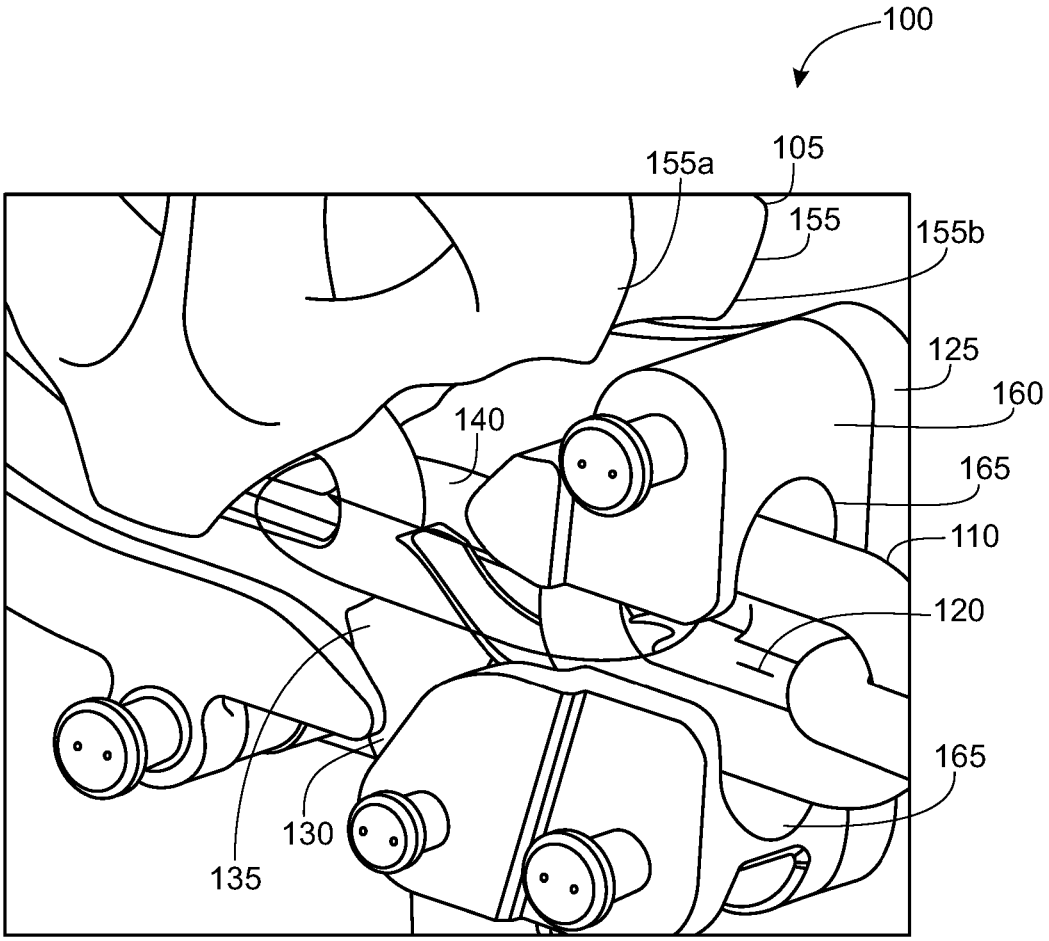
FIG. 12 a partial side view to an enlarged scale of the mooring apparatus of FIG. 4.
Figure 13:
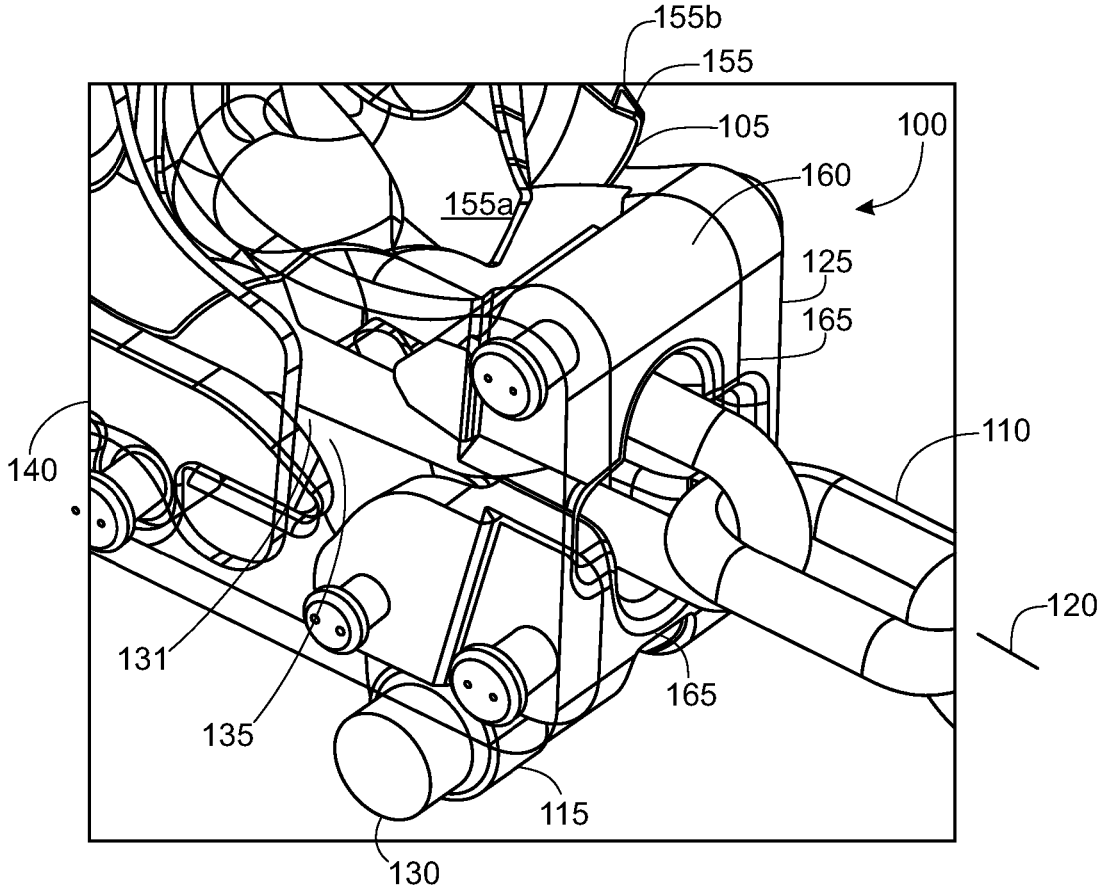
FIG. 13 a partial view from one side and one end and to an enlarged scale of the mooring apparatus of FIG. 4.

Referring now to FIGS. 2 and 3, there is shown an apparatus for mooring a structure, the apparatus comprising a mooring tensioner, generally designated 10 according to the prior art as disclosed in WO 2018/025018 A1 (FLINTSTONE TECHNOLOGY LIMITED).

Referring now to FIGS. 4 to 13, there is shown a (mooring and/or tensioning) apparatus or device, generally designated 100, according to an embodiment of the present invention. Hereinafter the apparatus or device 100 will be referred to as apparatus 100.

The apparatus 100 comprises:

- a guide portion (or sheave) 105 for guiding a portion of a first (working) mooring line 110, and
- a lock arrangement or means 115, wherein the apparatus 100 provides a mooring line path 120, the lock arrangement 115 is provided on an opposite side of the mooring line path 120 from the guide portion 105, and the lock arrangement 115 is providable between the guide portion 105 and a structure 200 to be moored, in use, at least in a locked disposition, e.g. along the mooring line path.

The lock arrangement 115 is providable between the guide portion 105 and a structure 200 to be moored along a path of a mooring line, i.e. along the mooring line path 120.

The lock arrangement 115 is provided proximal or adjacent the guide portion 105.

The apparatus 100 provides for a lock arrangement 115 which is significantly closer to the guide portion 105 than in the prior art. This can result in one or more advantages, e.g. reduced length, reduced weight, and/or reduce the cost of the apparatus 100.

The apparatus 100 also provides advantage over one or more prior art apparatus in that, in use, the mooring line 110 around the guide portion 105 is not under tension when the structure 200 is moored, since tension is taken by the lock arrangement 115.

The mooring line path 120 comprises a curved path. The mooring line path 120 comprises an included or interior angle $\alpha$, and an excluded or exterior angle R.

The guide portion 105 is provided on or within the interior angle $\alpha$ of the mooring line path. The lock arrangement 115 is provided on or within the exterior angle $\beta$ of the mooring line path 120, i.e. on an opposite side of the mooring line path from the guide portion 115, at least in an unlocked disposition.

The apparatus 100 comprises a body 125. The guide portion 105 is movably, i.e. rotatably, mounted on the body 125.

The lock arrangement 115 comprises a lock member 130 having a lock face or side 131. In a first (unlocked) disposition, the lock member 130 is distal or non-coincident with the mooring line path 120. In a second (locked) disposition, at least part of the lock member 130 is coincident with the mooring line path 120. (Further details with regard to the operation of the apparatus 100 can be understood from FIGS. 30(*a*) to (*d*) and FIGS. 31(*a*) to (*d*)). For example, in said second disposition, an end 135 of the lock member 130 engages with the mooring line 110, e.g. with a link 140 of a mooring line 110 comprising a mooring chain. The lock member 130 can be biased to the second disposition by biasing means (not shown).

The lock member 130 is connected to or provided on the body 125, i.e. pivotably attached to the body 125. A pivot 131 of the lock member 130 is on an opposite side of the mooring line path 120 than the guide portion 105.

The end 135 of the lock member 130 is closer to a structure 200 to be moored when in the second, locked, disposition than when in the first, unlocked, disposition.

The body 125 comprises an arrangement 145 for connecting or coupling the apparatus 100 to a second mooring line 150.

The guide portion 105 comprises a circular member or wheel. The guide portion 105 comprises a plurality of circumferentially disposed teeth 155, which may, in use, co-act with a/the end 135 of the lock member 130, for example, so as to lock a/the mooring line 110 relative to the apparatus 100 when the lock member 130 is in the second (locked) disposition. The lock member 130, therefore, acts as a pawl, which together with the toothed guide portion 105 can act as a ratchet type mechanism.

The lock arrangement 115 is conveniently referred to as a "chain stopper".

In this embodiment the guide portion 105 comprises first and second sides, which are circular and comprise respective first and second teeth 155*a*, 155*b*, pairs of which are circumferentially aligned, i.e. face one another.

At least a portion of the mooring line path 120 is provided between the first and second sides of the guide portion 105.

The body 115 comprises a guide arrangement 160 for guiding a portion of a mooring line 110, for example, into or out of the apparatus 100. In this embodiment the guide arrangement 160 comprise a pair of opposing guide members.

The lock arrangement 115 is provided between the guide portion 105 and the guide arrangement 160.

In use, when tension is applied to an end of a mooring line 110 distal a structure 200 or on an opposite side of the apparatus 100 from a structure 200, the lock member 130 will tend towards or be disposed in the first (unlocked) disposition. This allows the mooring line 110 to be tensioned.

In use, when tension is removed from an end of a mooring line 100 distal a structure 200 or an opposite side of the apparatus 100 from a structure 200, the lock member 130 will tend towards or be disposed in the second (locked) disposition. This allows the mooring line 110 to be locked (relative to the apparatus 100).

By this apparatus 100 a (first) mooring line 110 may be tensioned. The apparatus 100 comprises and/or can be referred to as a "mid-line tensioner".

The lock arrangement 115 comprises a mooring line lock, i.e. capable of locking or retaining the first mooring line 110.

In use, at least a portion of the first mooring line 110 is disposed, locked and/or secured by the lock arrangement 115 and the guide portion 105.

The at least a portion of the first mooring line 110 comprises a locked link 111. A link adjacent the locked link 111 in a direction away from the guide portion 105 can be referred to as a first loaded link 112. The lock member 130 has a lock face 131.

The lock arrangement 115 is adapted to secure and/or lock the first mooring line 110 between the lock arrangement 115 and an outer peripheral portion of body 125.

The guide portion 105 is rotatably connected to the body 125, e.g. on or around an axis.

The lock arrangement 115 and/or lock member 130 is hingedly or pivotably connected to the body 125, beneficially on a side of the mooring line path opposite the guide portion 105.

At least a portion of at least one or both of the mooring lines 110, 150 can be a chain, wire, rope, or the like. At least a portion of the first mooring line 110 can be a first chain. At least a portion of the second line mooring 150 can be a second chain.

The guide portion 105 can be a sheave or wheel, and/or can be substantially circular, such as a mooring line wheel or a chain wheel which can be rotatable relative to the body 125, such as around a central axis A of the guide portion 105. The guide portion 105 can be a sprag wheel. The guide portion 105 can be a sheave. The guide portion 105 can be a toothed wheel, such as a cogwheel, or the like.

The present invention provides an (mooring) apparatus or device 100 for mooring a structure 200, the apparatus or device 100 comprising:

- a body 125;
- a guide portion 105 for guiding a portion of a first mooring line 110;
- a lock arrangement or means 115, wherein
- the guide portion 105 is provided on and/or within a first side or end of the body 125, and the lock arrangement or means 115 is provided on and/or within a second side or end of the body 125, which second side or end at least partly opposes the first side or end.

The apparatus 100 provides mooring line path 120. The lock arrangement 125 is provided on an opposite side of the mooring line path 120 from the guide portion 105. The lock arrangement 115 is provided between the guide portion 105 and a structure 200 to be moored, in use.

Figure 14:
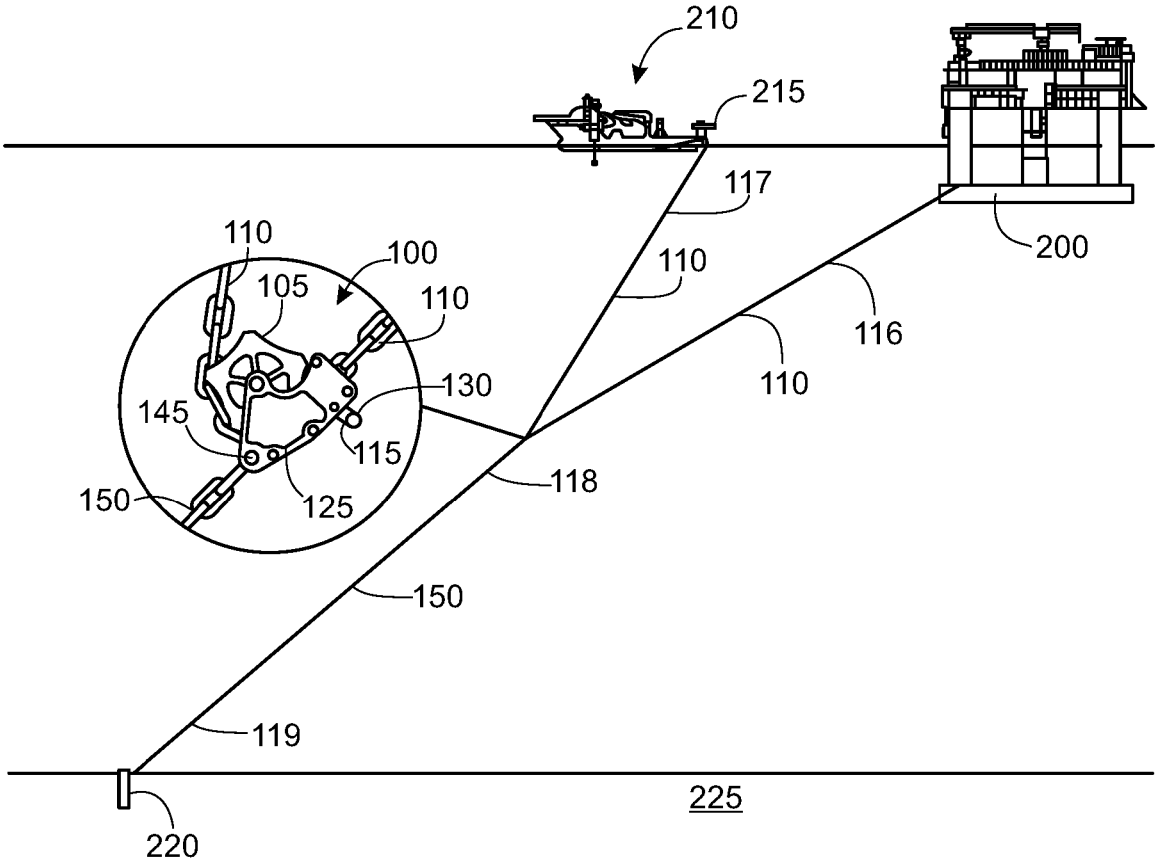
FIG. 14 a diagrammatic representation of a mooring system comprising a mooring apparatus of FIG. 4.

Referring to FIG. 14, the present invention provides a system 205 for tensioning a (first) mooring line 110, the system 205 comprises at least one mooring apparatus 110 as hereinbefore described.

The system 205 comprises a first mooring line 110. The system 205 comprises a second mooring line 150.

The system 205 moors at least one structure 205, such as a floating structure, an offshore structure, a floating platform or the like.

A portion of the first mooring line 110 is threaded or threadable through the apparatus 200.

A first portion or end 116 of the first mooring line 110 is configured to be connected or connectable to the structure 200.

The system 205 can comprise a buoy (not shown). The system 205 comprises a floating vessel 210. The system 205 comprises a winch and/or a pulley 215. The winch and/or pulley 215 may be located on or in the floating vessel 210. The buoy can be a submersible buoy, a semi-submersible buoy, a submerged turret production buoy, a submerged turret loading buoy or the like.

A second portion or end 117 of the first mooring line 110 is configured to be connected to the buoy and/or the floating vessel and/or the winch and/or the pulley 215. The winch and/or pulley 215 can be adapted to set, adjust or increase a tension in the first mooring line 110.

A first portion or end 118 of the second mooring line 115 can be connected to at least a portion of the apparatus 110. The first portion or end 116 of the second mooring line 150 can be connected to the body 125. The first portion of the second mooring line 150 can be releasably connected to the body 125.

The system 205 comprises an anchor 220. The anchor 220 comprises an anchoring point. The anchor 220 can be a pile, such as a suction pile or the like. The anchor 220 can be a subsea formation. The anchor 220 can be adapted for use on a seabed 225.

A second portion 119 of the second mooring line 150 can be connected to the anchor 220 or to the anchoring point.

The present invention provides a method of tensioning a (first) mooring line 110, wherein the method comprises:

providing a system 205 for tensioning a (first) mooring line 110 as hereinbefore described, the method (further) comprising:

applying a pulling force to a portion 117 of a first mooring line 110 in a direction away from the apparatus 100.

The pulling force can cause the apparatus 100 to pull at least one other portion of the first mooring line 110 towards a second mooring line 150.

The pulling force can cause the apparatus 100 to pull at least one other portion of the first mooring line 110 towards the apparatus 100.

When an appropriate or desired tension has been applied to the mooring line 110, the lock arrangement 115 can be disposed in the locked position.

When an appropriate or desired tension has been applied to the mooring line 110, the portion or end 117 of the first mooring line 110 can be attached to a buoy, or the like.

When an appropriate tension has been applied to the mooring line 110, at least a portion of the first portion of the first mooring line 110 can be cut away and/or removed and/or secured to the apparatus 100 and/or secured to the first and/or second mooring lines 110, 150.

The present invention provides a method for releasing tension in a mooring line, the method comprising:

providing a system for tensioning a mooring line as hereinbefore described, the method (further) comprising:

applying a pulling force to a/the first portion 112 of a/the first mooring line 110 in a direction away from the apparatus 100;

releasing the lock 115 from a locked disposition and/or retaining the lock 115 arrangement in a unlocked disposition; and reducing and/or removing the pulling force.

The step of retaining the lock arrangement 115 in the unlocked disposition can require removal and/or repositioning and/or insertion of at least one locking pin (not shown).

Figure 15:
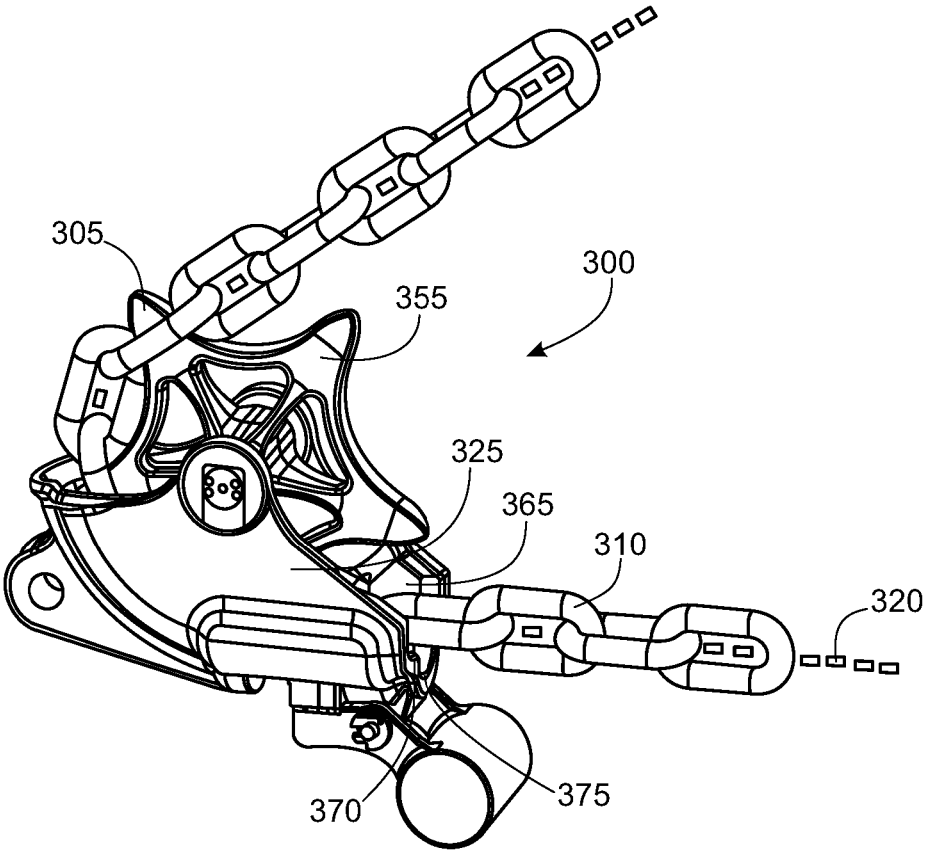
FIG. 15 a perspective view of a mooring apparatus or device according to an embodiment of the present invention.
Figure 16:
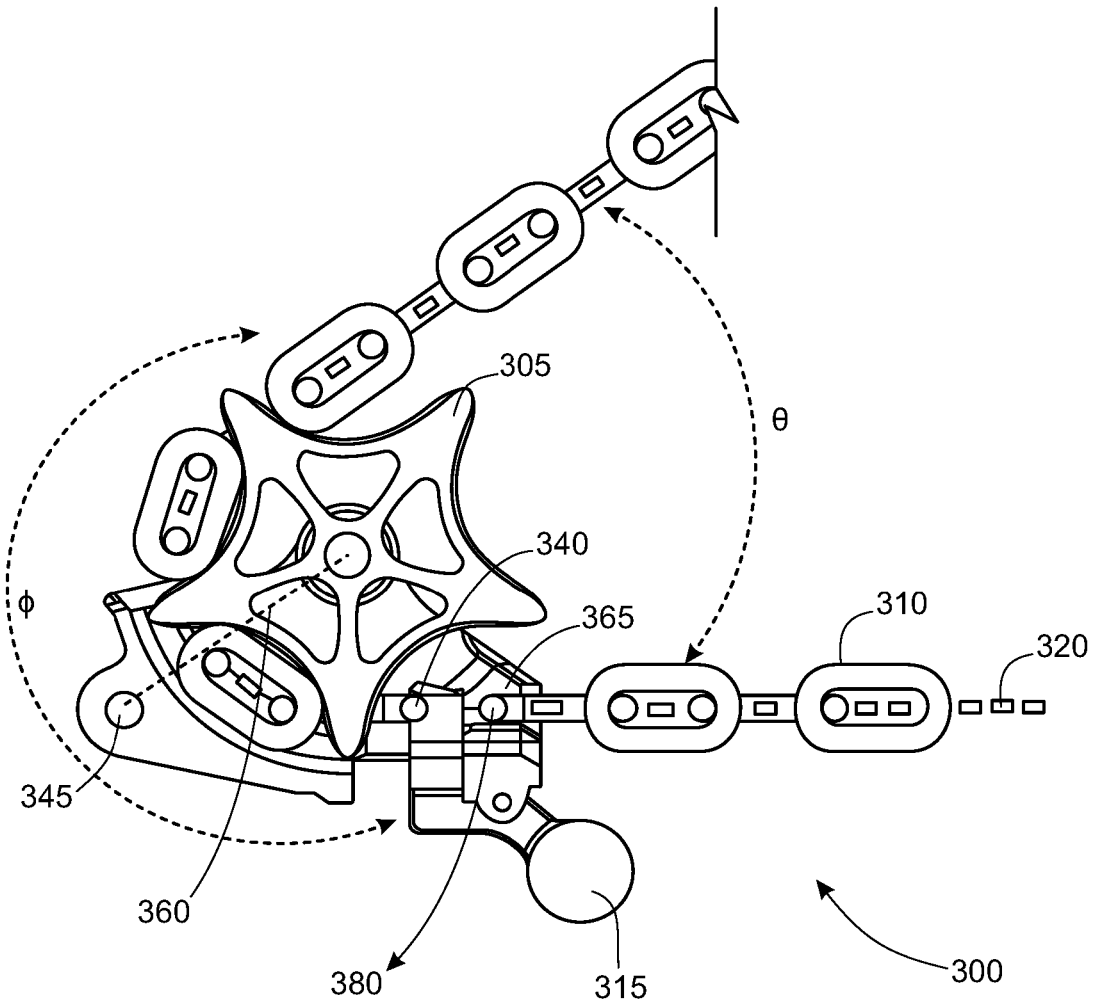
FIG. 16 a cross-sectional side view of the mooring apparatus or device of FIG. 15.

Referring now to FIGS. 15 and 16, there is shown a mooring and/or tensioning apparatus or device, generally designated 300, according to an embodiment of the present invention. Hereinafter the apparatus or device 300 will be referred to as apparatus 300.

The apparatus 300 comprises a body 325 and a guide portion 305 for guiding at least a portion of a first mooring line 310 along a mooring line path 320. The body 325 comprises an open channel 365 for guiding and seating the first mooring line 310.

Figure 17:
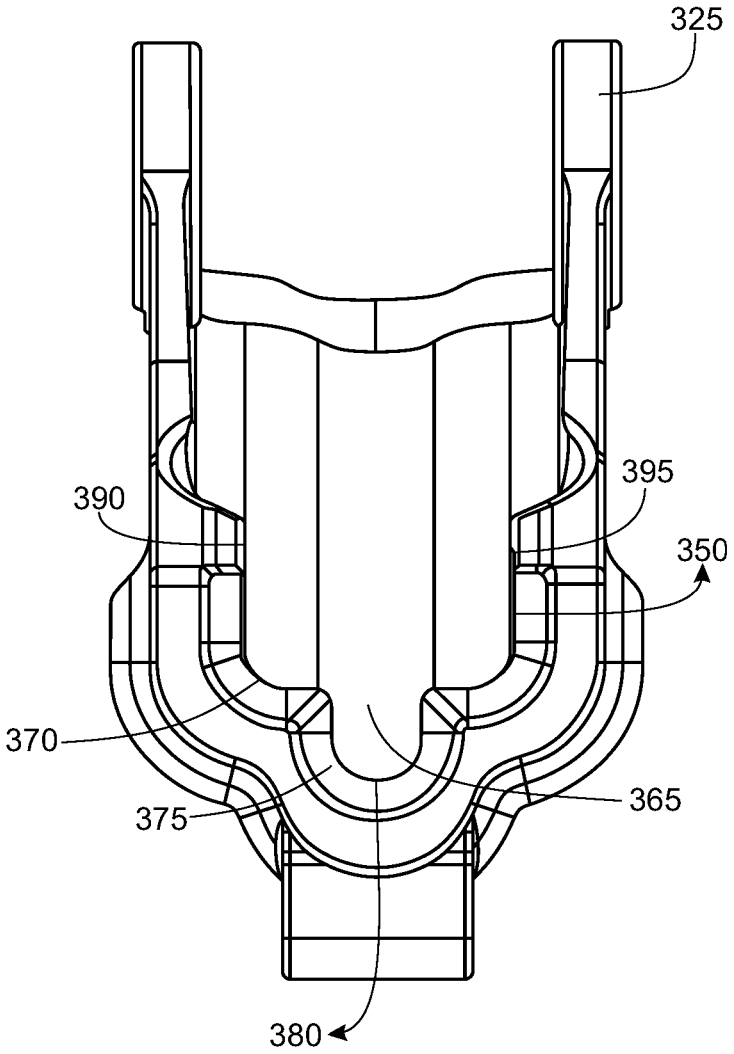
FIG. 17 a front view of a body of the mooring apparatus or device of FIG. 15.

The open channel 365 comprises a partial-cruciform or half-cruciform shaped surface, as can be seen more clearly in FIG. 17, which shows a front view of the body 325 of the mooring apparatus 300 of FIGS. 15 and 16. That is, a cross-section of the open channel 365 is substantially T-shaped, as described in more detail below.

The open channel 365 comprises a first U-shaped surface 370, with a second, smaller U-shaped surface 375 disposed at a mid-point of the first U-shaped shaped surface 370. In other embodiments, the open channel 365 comprises a first D-shaped surface, with a second, smaller D-shaped surface disposed at a mid-point of the first D-shaped shaped surface. In yet further embodiments, the open channel 365 corresponds to a first trough 370, with a second smaller trough 375 disposed at a mid-point of the deepest portion of first trough 370.

The surface 370, 375 of the open channel is shaped and sized to conform to at least a portion of the first mooring line 310.

The surface 370, 375 of the open channel 365 is configured to seat the mooring line 310.

The surface 370, 375 of the open channel 365 is configured to inhibit pivoting of the mooring line 310 relative to the body 325 in a first direction 380 perpendicular to the mooring line path 320 and away from the guide portion 305.

The open channel 365 is provided to allow pivoting of the mooring line 310 relative to the body 325 between a/the surface of the open channel 365 and the guide portion 305.

The open channel 365 may comprise sidewalls 390, 395 configured to inhibit pivoting of the mooring line 310 in a third direction 350, the third direction being perpendicular to the mooring line path 320 and the first direction 380.

The body 325 comprises a connection portion 345 for connecting or coupling the apparatus 300 to a second mooring line (not shown).

The connection portion 345 may comprise a pad-eye, shackle or clevis. In the example embodiment of FIGS. 15, 16 and 17, the connection portion 345 is a padeye. The guide portion 305 is disposed between the connection portion 345 and the open channel 365.

The connection portion 345 is disposed on the body 325 such that, during tensioning of the first 310 and second mooring lines, the first mooring line 310 moves or pivots relative to the body 325 in response to a tilting or rotation of the body 325. The movement or pivoting of the first mooring line 310 relative to the body 325 is movement or pivoting between the surface 370, 375 of the open channel 365 and the guide portion 305.

In use, the first mooring line 310 is free to move or pivot in the open channel 365, relative to the body 325.

The connection portion 345 is disposed on the body 325 such that, during tensioning of the mooring lines, the body 325 tends to tilt or rotate to align a line 360 between a centre of the guide portion and the connection portion with the second mooring line.

The apparatus 300 further comprises a lock arrangement or means 315, wherein the lock arrangement 315 is provided on an opposite side of the mooring line path 320 from the guide portion 305, and the lock arrangement 315 is provided between the guide portion 305 and a structure to be moored, in use.

The lock arrangement 315 is provided between the guide portion 305 and a structure (not shown) to be moored along a path of a mooring line, i.e. along the mooring line path 320.

The lock arrangement 315 is adapted to engage the first mooring line 310 to inhibit movement of the first mooring line 310 relative to the body 325 in a direction along the mooring line path 320 and allow movement of the first mooring line 310 relative to the body 325 in an opposite direction along the mooring line path 320.

The lock arrangement 315 is provided, e.g. at least in an unlocked disposition, on an opposite side of the mooring line path 320 from the guide portion 305'.

The lock arrangement 315 is adapted to be provided, e.g. at least in a locked disposition, between the guide portion 305 and a structure to be moored, in use.

In the example embodiment of FIGS. 15, 16 and 17, the lock arrangement 315 is configurable to straddle the guide portion 305. In the example embodiment of FIGS. 15, 16 and 17, the lock arrangement 315 is configurable to straddle the first mooring line 310.

Figure 18:
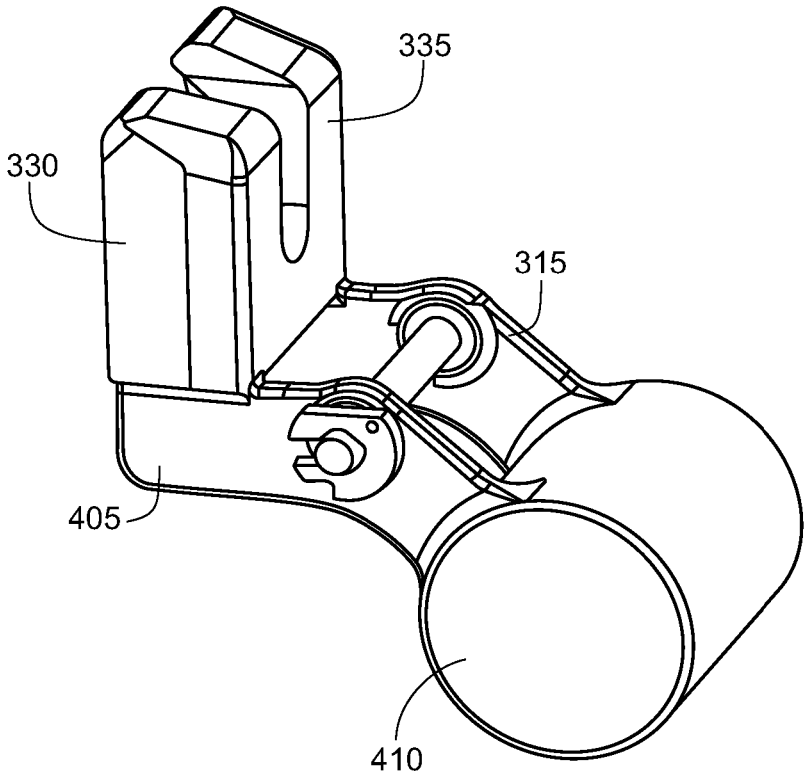
FIG. 18 a perspective view of a lock arrangement of the mooring apparatus or device of FIG. 15.

The lock arrangement 315 comprises a pivotable member or clacker 405, as shown in FIG. 18.

The lock arrangement 315 comprises a counterweight 410 (which can be removable) for biasing the pivotable member or clacker 405 towards engagement with the first mooring line 310.

The lock arrangement 315 is adapted to hold or seat the mooring line 310 between the guide portion 305 and the pivotable member or clacker 405.

In use, at least a portion of the first mooring line 310 is disposed between the lock arrangement 315 and the guide portion 305.

The lock arrangement 315 is provided proximal or adjacent the guide portion 305.

The apparatus 300 provides for a lock arrangement 315 which is significantly closer to the guide portion 305 than in the prior art. This can result in one or more advantages, e.g. reduced length, reduced weight, and/or reduce the cost of the apparatus 300.

The apparatus 300 also provides advantage over one or more prior art apparatus in that, in use, the mooring line 310 around the guide portion 305 is not under tension when the structure (not shown) is moored, since tension is taken by the lock arrangement 315.

The mooring line path 320 comprises a curved path. The mooring line path 320 comprises an included or interior angle $\Theta$ and an excluded or exterior angle 4).

The guide portion 305 is provided on or within the interior angle $\Theta$ of the mooring line path. The lock arrangement or means 315 is provided, at least in an unlocked disposition, on or within the exterior angle $\phi$ of the mooring line path 320, i.e. on an opposite side of the mooring line path from the guide portion 315.

The apparatus 300 comprises a body 325. The guide portion 305 is movably, e.g. rotatably, mounted on the body 325.

The lock arrangement 315 comprises a lock member 330, e.g. pivotable member or clacker 405. In a first (unlocked) disposition, the lock member 330 is distal or non-coincident with the mooring line path 320. In a second (locked) disposition, at least part of the lock member 330 is coincident with the mooring line path 320. For example, in said second disposition, an end 335 of the lock member 330 engages with the mooring line 310, e.g. with a link 340 of a mooring line 310 comprising a mooring chain. The lock member 330 can be biased to the second disposition by biasing means (not shown).

The lock member 330 is connected to or provided on the body 325, e.g. pivotably attached to the body 325.

The end 335 of the lock member 330 is closer to a structure (not shown) to be moored when in the second, locked, disposition than when in the first, unlocked, disposition.

The apparatus 300 comprises a mid-line tensioner.

The guide portion 305 comprises a circular member or wheel. The guide portion 305 comprises a plurality of circumferentially disposed teeth 355, which may, in use, co-act with a/the end 335 of the lock member 330, for example, so as to lock a/the mooring line 310 relative to the apparatus 300 when the lock member 330 is in the second locked disposition. The lock member 330, therefore, acts as a pawl, which together with the toothed guide portion 305 can act as a ratchet type mechanism.

The lock arrangement 315 is conveniently referred to as a "chain stopper".

The lock arrangement 315 is provided between the guide portion 305 and the open channel 365.

In use, when tension is applied to an end of a mooring line 310 distal a structure (not shown) or on an opposite side of the apparatus 300 from a structure, the lock member 330 will tend towards or be disposed in the second (locked) disposition. This allows the mooring line 310 to be tensioned.

In use, when tension is removed from an end of a mooring line 300 distal a structure (not shown) or an opposite side of the apparatus 300 from a structure, the lock member 330 will tend towards or be disposed in the first (unlocked) disposition.

By this apparatus 300 a (first) mooring line 310 may be tensioned. The apparatus 300 can be referred to as a "mid-line tensioner".

The lock arrangement 315 comprises a mooring line lock, i.e. capable of locking or retaining the first mooring line 310.

In use, at least a portion of the first mooring line 310 is disposed, locked and/or secured by the lock arrangement 315 and the guide portion 305.

The guide portion 305 is rotatably connected to the body 325, e.g. on or around an axis.

The lock arrangement 315 and/or lock member 330 is hingedly or pivotably connected to the body 325.

At least a portion of the mooring lines 310 can be a chain, wire, rope, or the like.

The guide portion 305 can be a wheel and/or can be substantially circular, such as a mooring line wheel or a chain wheel which is rotatable relative to the body 325, such as around a central axis of the guide portion 305. The guide portion 305 can be a sprag wheel. The guide portion 305 can be a sheave. The guide portion 305 can be a toothed wheel, such as a cogwheel, sprocket, or the like.

The apparatus 300 may be suitable for offshore and/or subsea operations and may be submerged in use.

Figure 19:
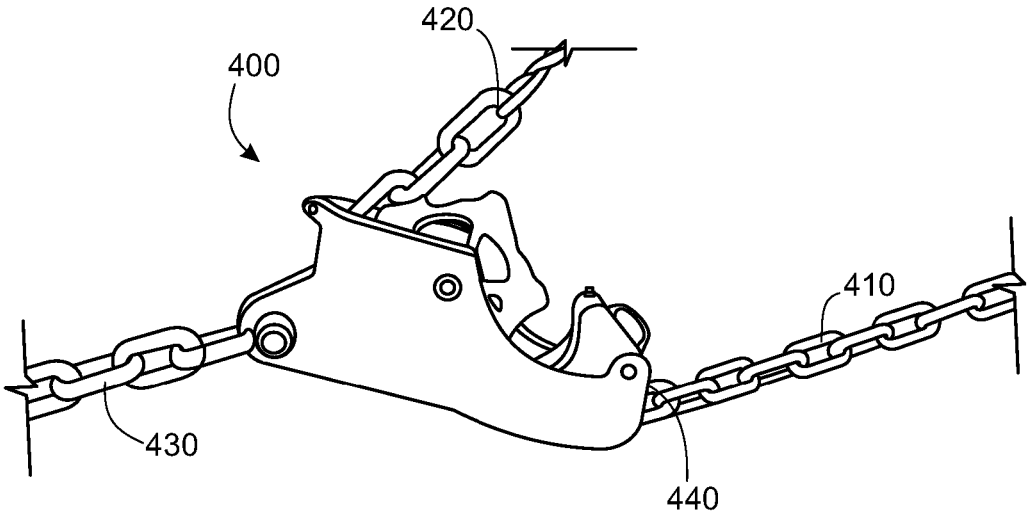
FIG. 19 a photograph of a mooring apparatus or device in use.

FIG. 19 shows a photograph of an apparatus, generally denoted 400, in use. The apparatus 400 does not comprise an open channel for guiding and/or seating a first mooring line 410. The first mooring line 410 is being pulled along a path indicated by arrow 420, thus tensioning the first mooring line 410 and a second mooring line 430. It can be seen the first mooring line 410, which is a mooring chain, interferes with an upper portion of a closed channel 440. That is, during tensioning of the mooring lines 410, 430, the apparatus 100 may obstruct movement of the first mooring line 410 relative to the apparatus 400, due to an angle at which the first mooring line 410 enters the closed channel 440 of the apparatus 400. Such interference may result in the first mooring line 400 moving in a jolting manner relative to the apparatus 400, and may result in damage to the first mooring line 410 and/or the apparatus 400. Furthermore, such behaviour may potentially lead to a jamming of the first mooring line 410 in or around the apparatus 400.

Figure 20A:
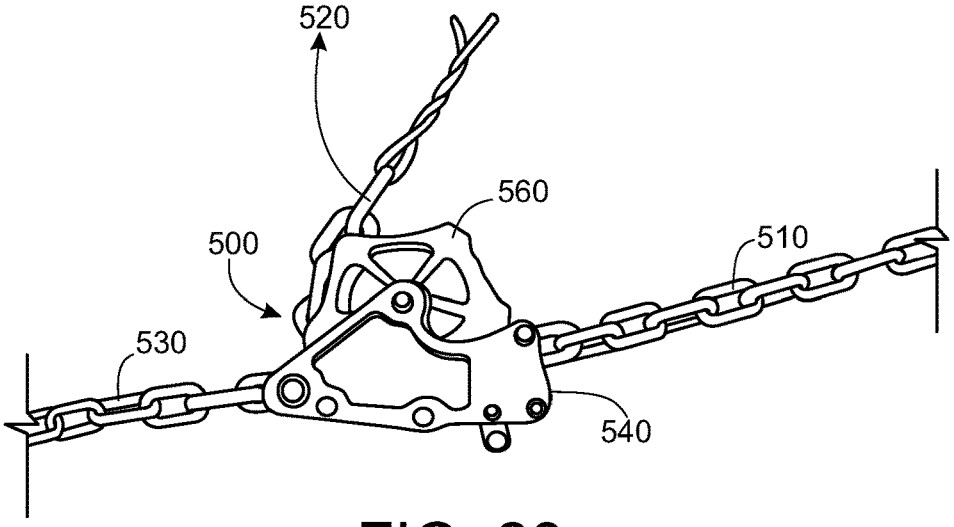
FIGS. 20(*a*) to (*c*) a series of photographs of a mooring apparatus or device according to an embodiment of the present invention in use.

FIGS. 20(*a*) to (*c*) shows a series of photographs of an apparatus 500 according to an embodiment of the present invention. In FIG. 20(*a*), a first mooring line 510 and a second mooring line 530 are under a low tension, e.g. a substantial tensioning force in a direction indicated by arrow 520 has not yet been applied to the first mooring line 510. The apparatus 500 does comprises an open channel 540 for guiding and/or seating a first mooring line 510.

Figure 20B:
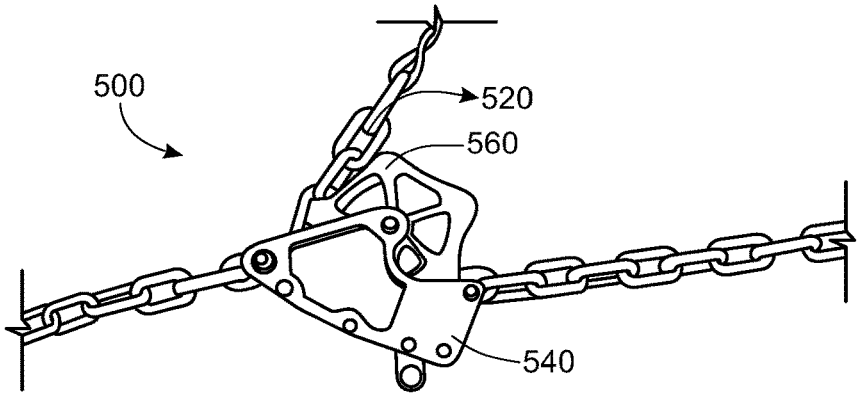
Figure 20C:
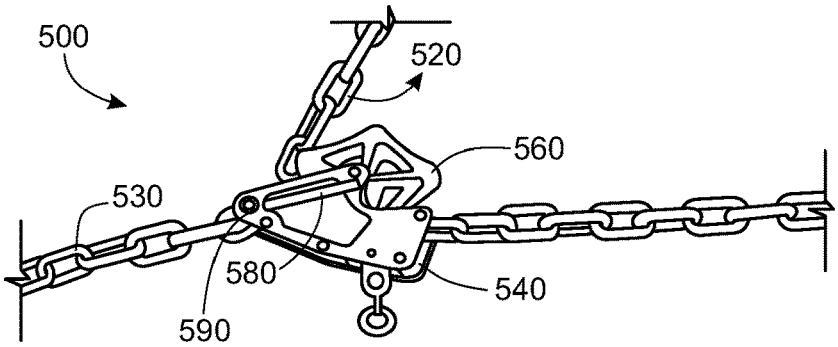

In FIG. 20(*b*), the first mooring line 510 is being pulled along a path indicated by arrow 520, thus tensioning the first mooring line 510 and a second mooring line 530. In contrast to FIG. 19, it can be seen that the first mooring line 510, which is a mooring chain, does not interferes with the channel 540. That is, during tensioning of the mooring lines 510, 530, due to the open channel 540, the apparatus 500 does not obstruct movement of the first mooring line 510 towards a guide portion 560. FIG. 20*c* shows the first mooring line 510 and the second mooring line 530 further tensioned relative to FIG. 20*b*. It can be seen that during tensioning of the mooring lines 510, 530, a body 570 of the apparatus 500 tends to tilt or rotate to align a line 580 between a centre of the guide portion and a connection portion 590 with the second mooring line 530.

Figure 21A:
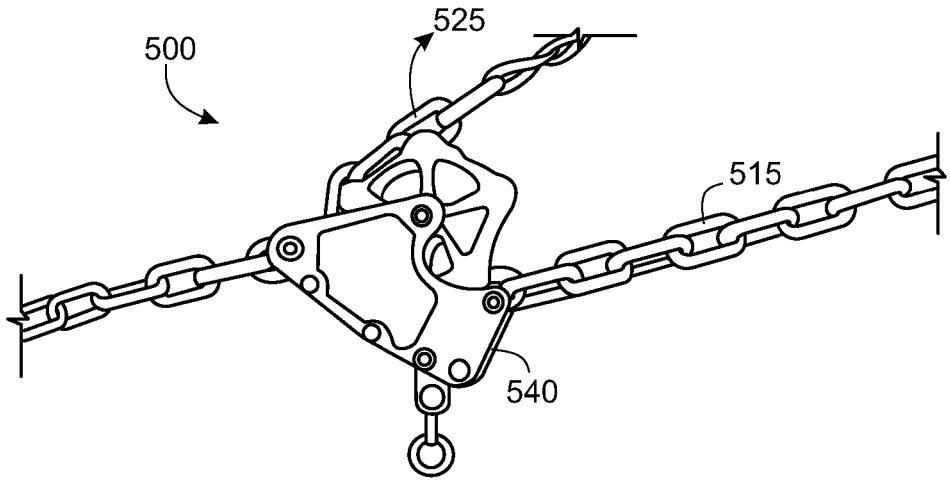
FIGS. 21(*a*) to (*b*) a further series of photographs of a mooring apparatus or device according to an embodiment of the present invention in use.
Figure 21B:
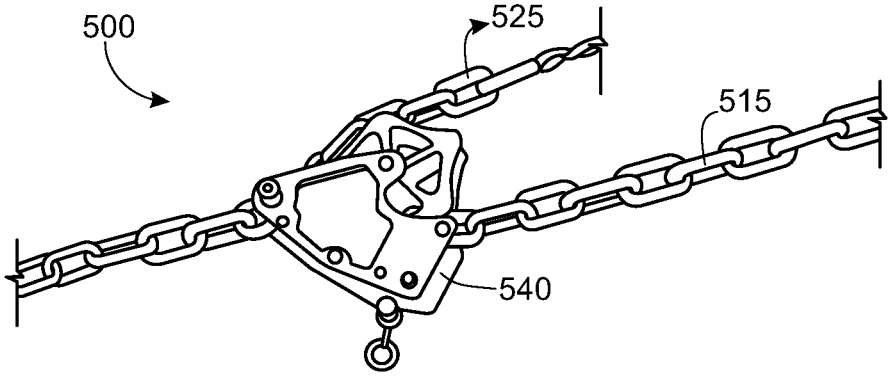

FIGS. 21(*a*) and 21(*b*) show a further series of photographs of the mooring apparatus 500 in use. In FIGS. 21(*a*) and 21(*b*), the first mooring line 510 is being pulled along a path indicated by arrow 525, thus tensioning the first mooring line 510 and the second mooring line 530. In contrast to FIG. 20*b*, it can be seen that an angle between arrow 525 and a portion of the first mooring line 515 is substantially lower than an angle between arrow 525 and a portion of the first mooring line 515 in FIG. 20(*b*). That is, a wrap angle around guide portion 560 is larger in FIGS. 21(*a*) and 21(*b*) than in FIG. 20(*b*). As a result, the first mooring line 510 is lifted further into the open channel.

Referring to FIGS. 22 to 25 there is shown an apparatus 600 according to an embodiment of the present invention and referred to as a compact tensioner. The apparatus 600 is similar to the mooring apparatus 500 of FIG. 22(*a*), like parts being identified by like numerals, but iterated by "100".

Figure 22:
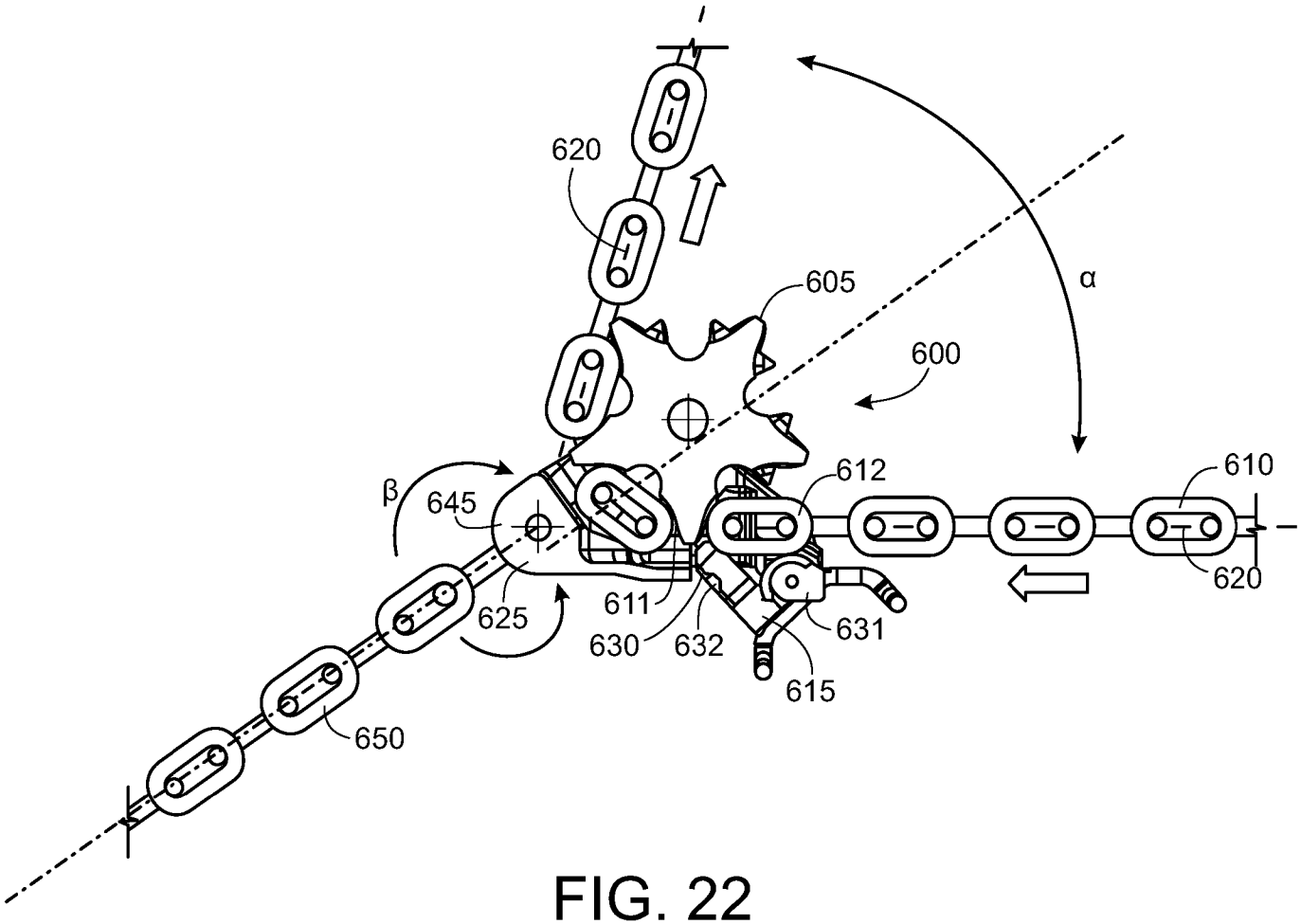
FIGS. 22 to 25 a series of sectional side views of a mooring apparatus according to an embodiment of the present invention.

FIG. 22 shows during tensioning a relatively large vale for internal (wrap) angle α where the first mooring line 610 is in contact with or touches the open channel 665.

Figure 23:
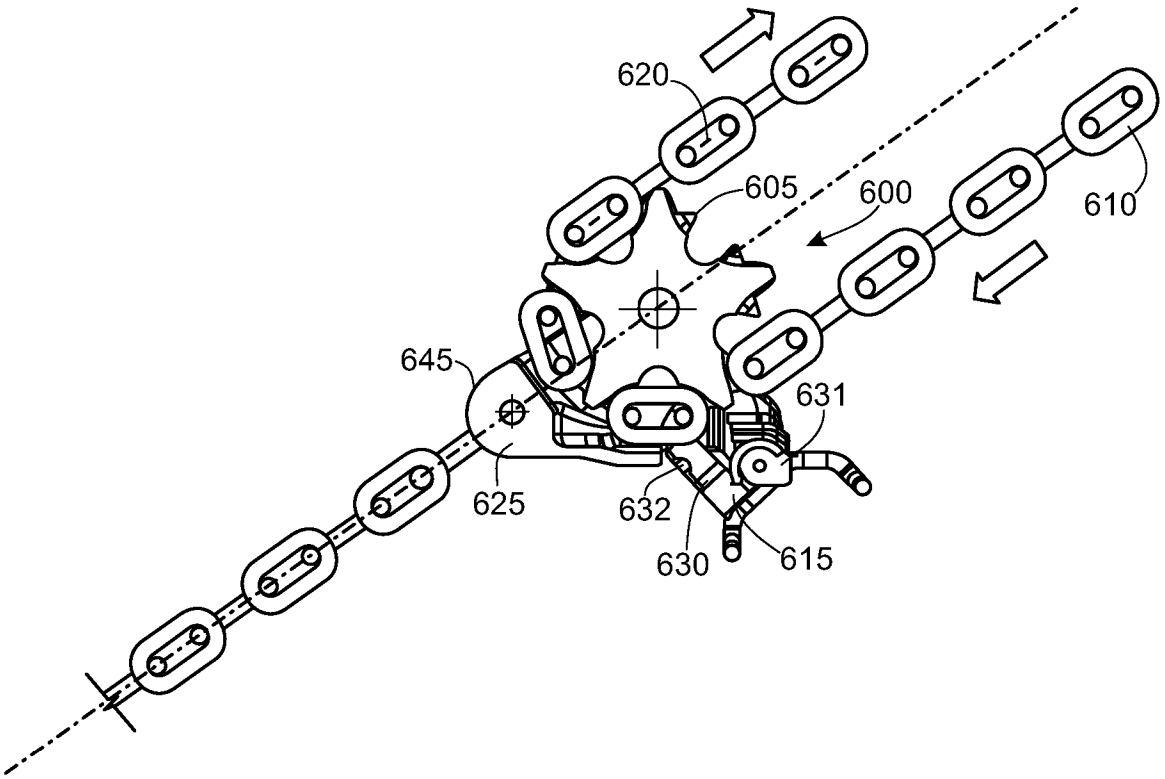

FIG. 23 shows during tensioning a relatively small value for the internal angle α where the first mooring line is biased towards the guide portion 605 and away from the open channel 665. This can reduce the opportunity for chaffing of the first mooring line 610 on entry to the apparatus 500.

In both of FIGS. 22 and 23 the lock arrangement 615 is in an unlocked disposition and provided in an opposite side of the mooring line path 620 than the guide portion 605.

It should be noted that the lock arrangement 615 can be provided with a temporary (e.g. removable) or permanent counterweight.

Figure 24:
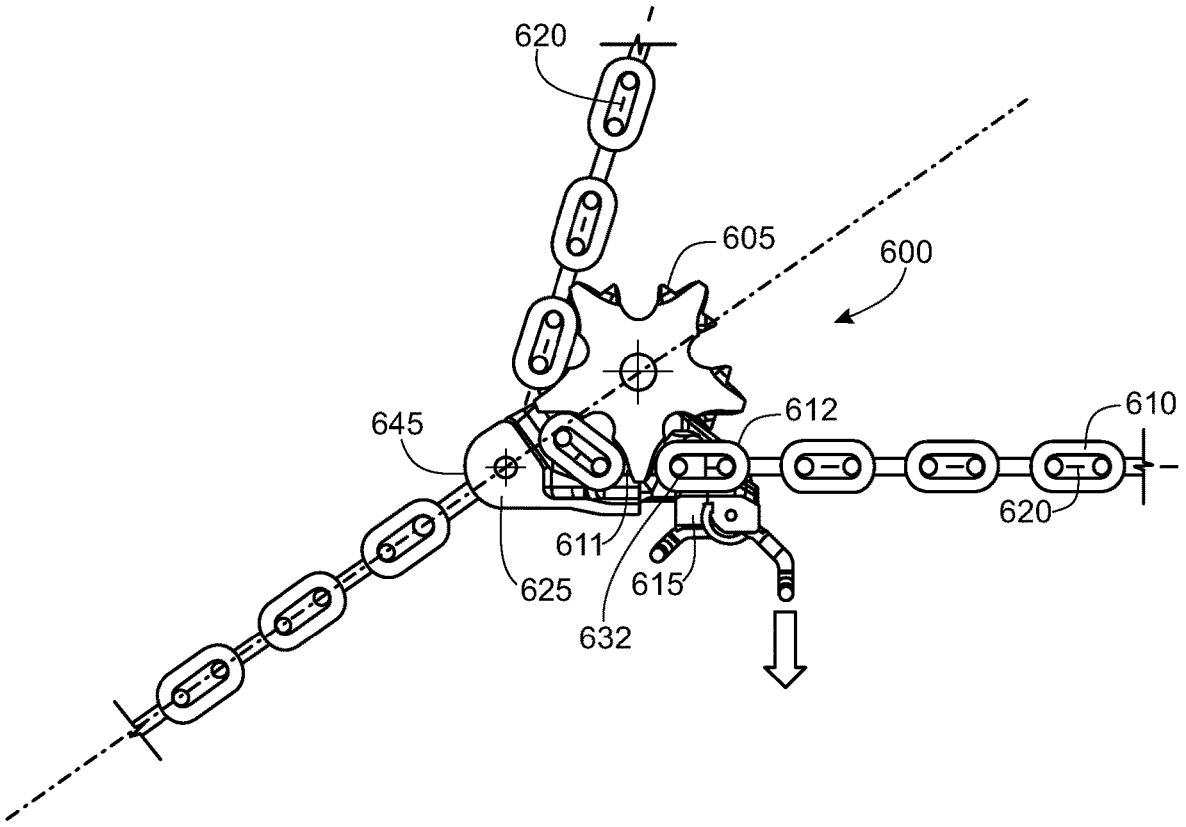

Referring to FIG. 24, the apparatus 500 is shown with the first mooring line 610 tensioned. The lock arrangement 615 is in a locked disposition and at least partly provided on the mooring path 620 and engaged with the first mooring line 610. In particular a lock (or stopper) face of the lock arrangement 615 abuts a locked line.

Figure 25:
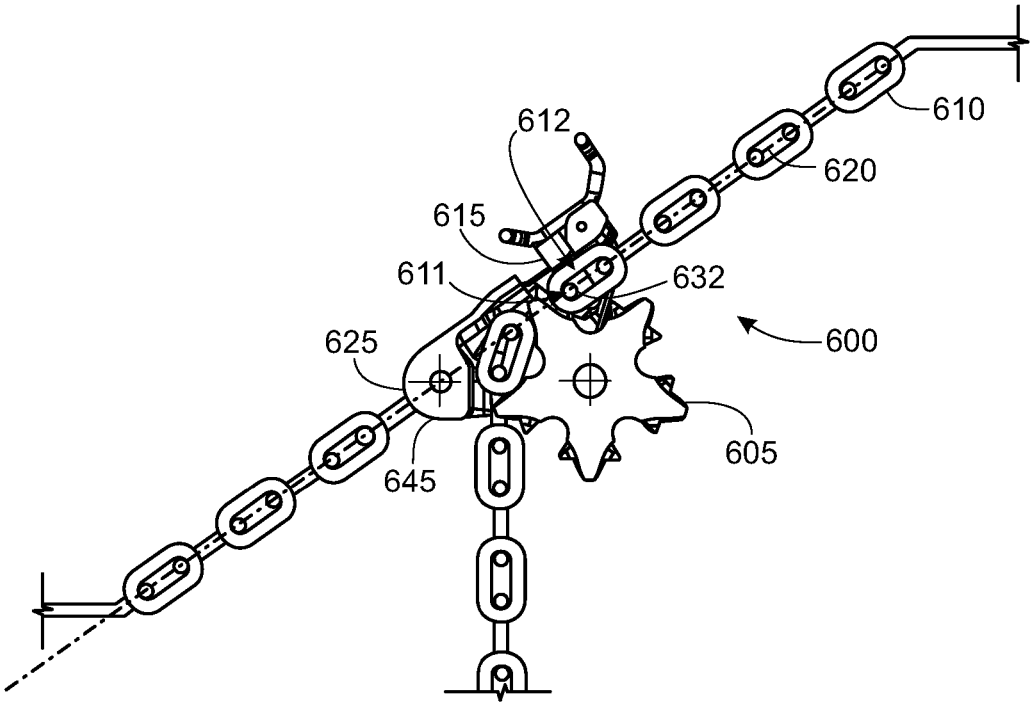

Referring to FIG. 25, once tensioned as shown in FIG. 24, excess chain can be released (and allowed to drop down).

The apparatus 600 can invert into an in-service disposition.

It should be noted that the locked link is engaged with the guide portion 605 (or dynamic guide).

It should be noted that a first clouded link is in line with a idealised or virtual mooring line path.

Figure 26:
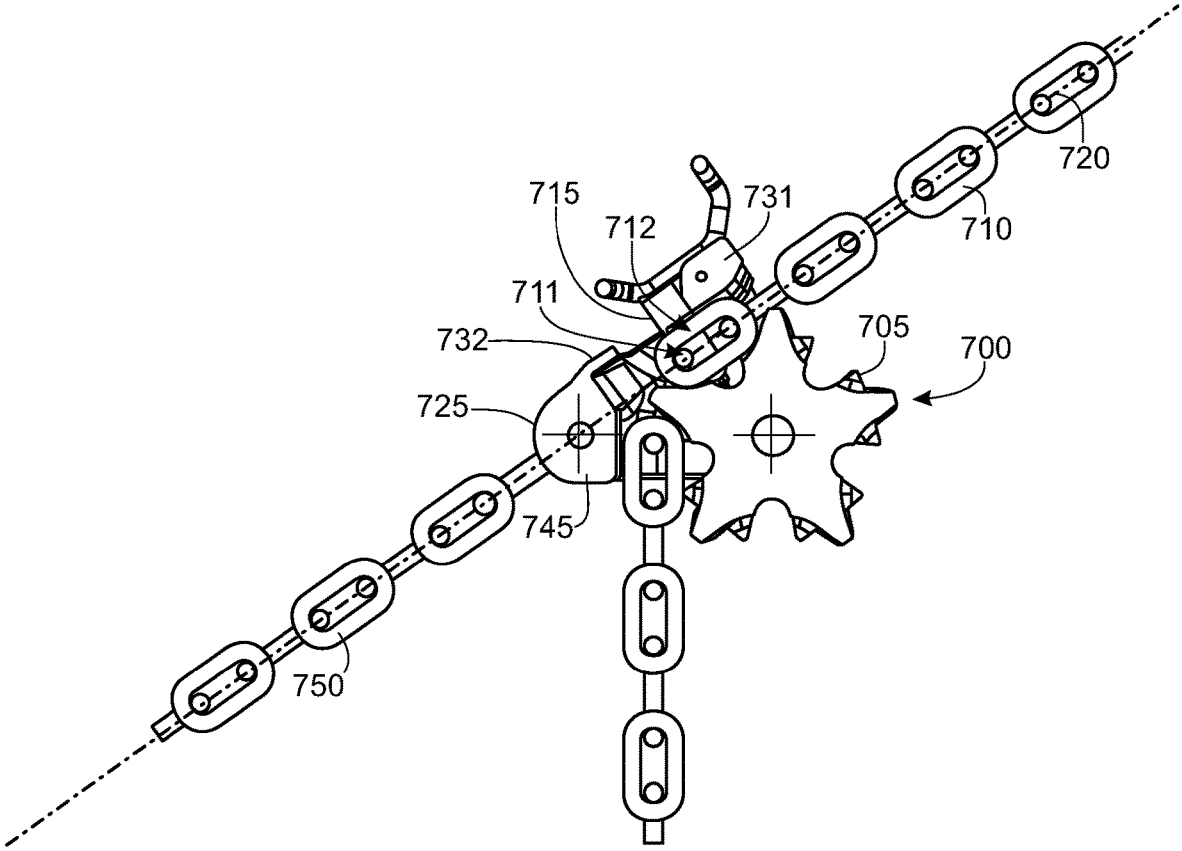
FIG. 26 a sectional side view of a mooring apparatus according to an embodiment of the present invention.

Referring to FIG. 26, there is shown an apparatus 700 accordingly to an embodiment of the present invention and referred to as an "ultra-compact" tensioner. The apparatus 700 is similar to the apparatus 600 pf FIGS. 22 to 25, like parts being identified by the numerals, but iterated by "100".

FIG. 26 shown the mooring apparatus 700 in an in-service disposition similar to that of the apparatus 600 is shown in FIG. 25.

It should be noted that the locked link is engaged with the guide portion 605 (or dynamic guide).

It should be noted that a first loaded link is in line with an idealised virtual mooring line path.

Figure 27A:
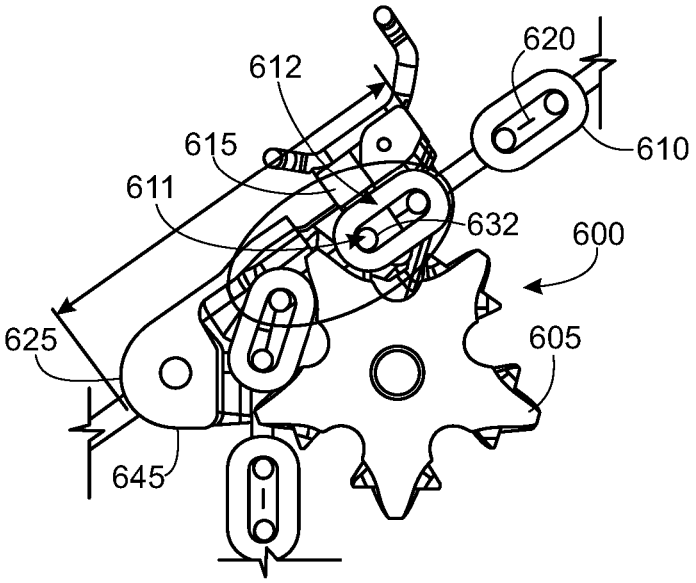
FIGS. 27 (*a*) and (*b*) detailed sectional side view of the mooring apparatus of FIGS. 22 and 25 respectively.
Figure 27B:
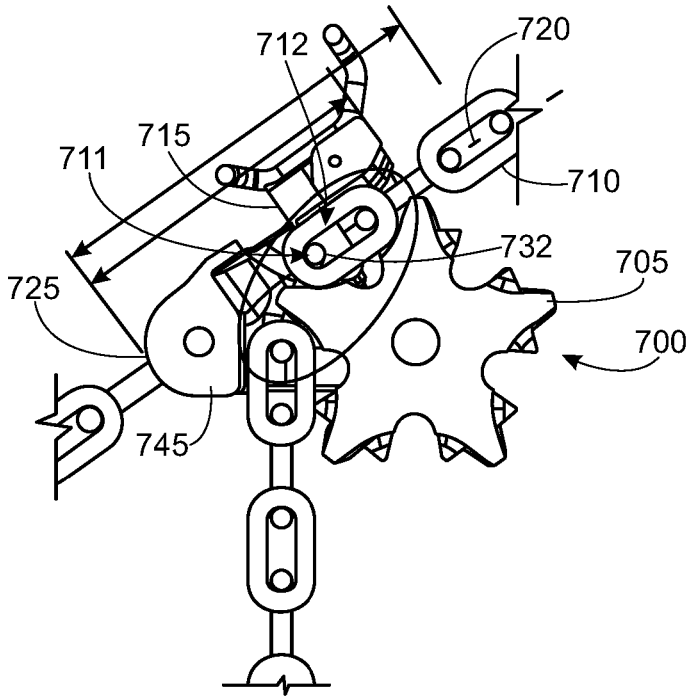
Figure 28A:
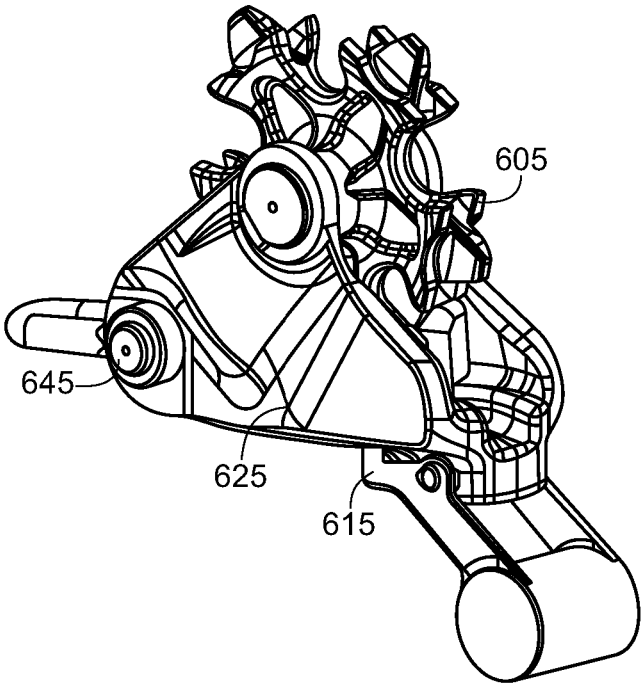
FIGS. 28 (*a*) to (*d*) perspective views of first to fourth mooring apparatus according to embodiments of the present invention.
Figure 28B:
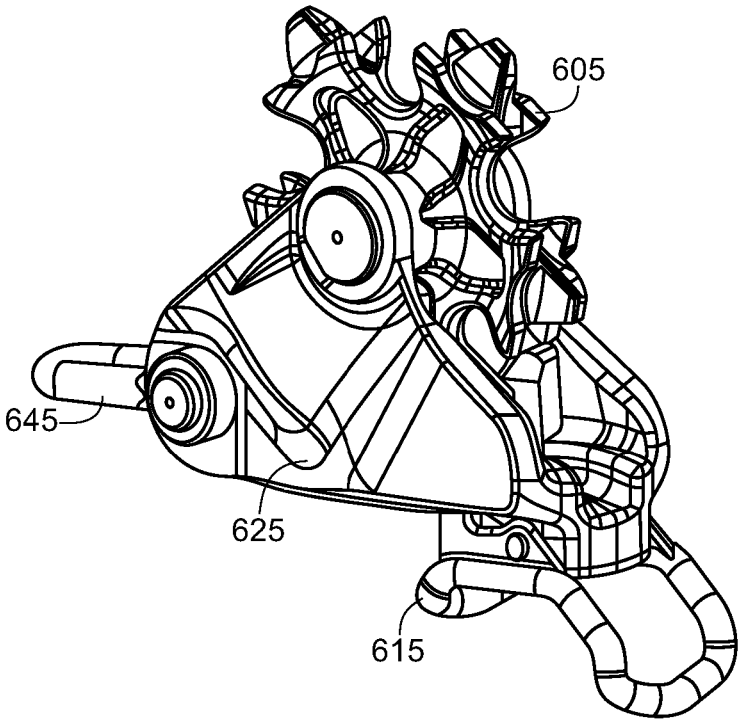
Figure 28C:
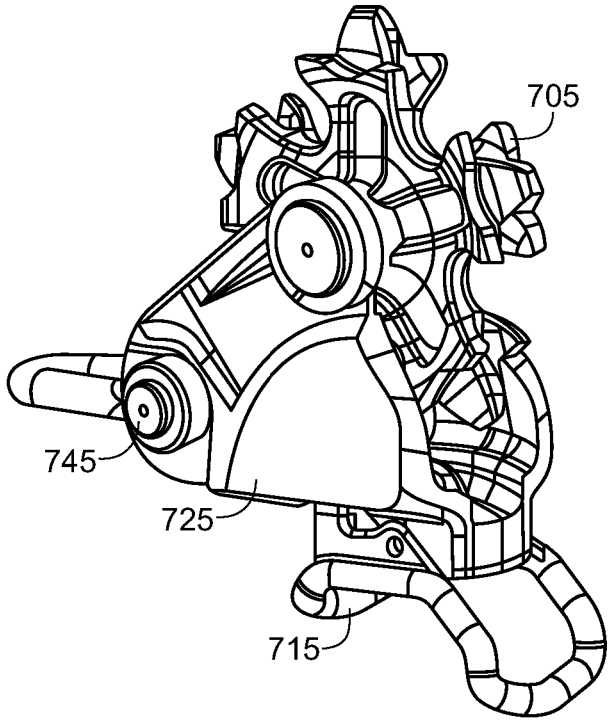
Figure 28D:
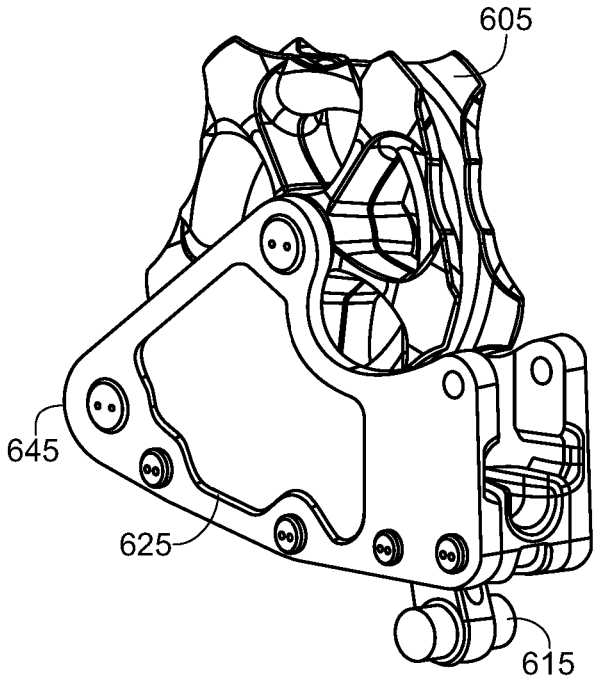

Referring to FIG. 27(*a*), there is shown in further detail the apparatus 600 of FIGS. 22 to 25, and the positions of the locked link and first loaded link.

Referring to FIG. 27(*b*), there is shown in further detail the apparatus 600 of FIG. 26 and the positions of the locked link and first loaded link.

Referring to FIGS. 28(*a*) to (*d*), there are shown first to fourth apparatus according to embodiments of the present invention.

The first to fourth apparatus are similar to the mooring apparatus of FIG. 26, like parts being identified by like numerals bit iterated by "100" and suffixed "a" to "d" respectively.

FIGS. 28(*a*) to (*d*) shows the following apparatus:

| Figure | Guide Portion comprising | Lock Arrangement comprising | Counterweight which is |
|---|---|---|---|
| 28(a) | Groove wheel | Finger/pin type stopper | Permanent |
| 28(b) | Groove wheel | Finger/pin type stopper | Temporary |
| 28(c) | Spur toothed wheel | Yoke type stopper | Temporary |
| 28(d) | Groove wheel | Finger/pin type stopper | Permanent |

Figure 29A:
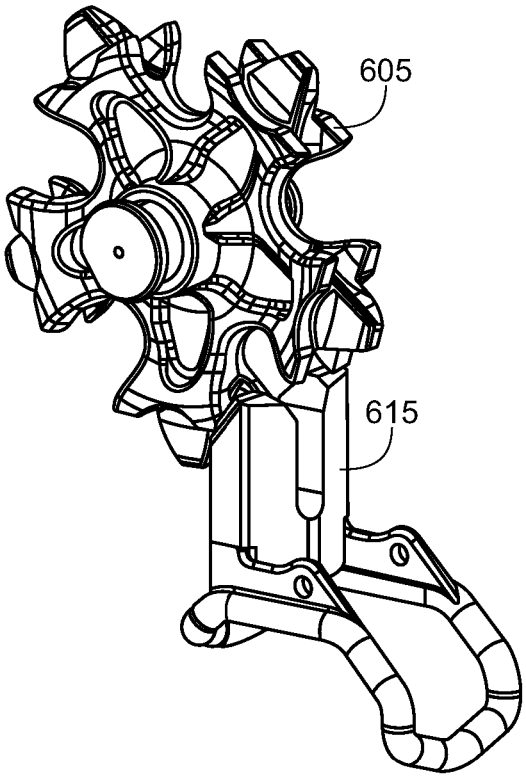
FIGS. 29(*a*) and (*b*) first and second combination of guide portions and lock members for use in embodiments of the present invention.
Figure 29B:
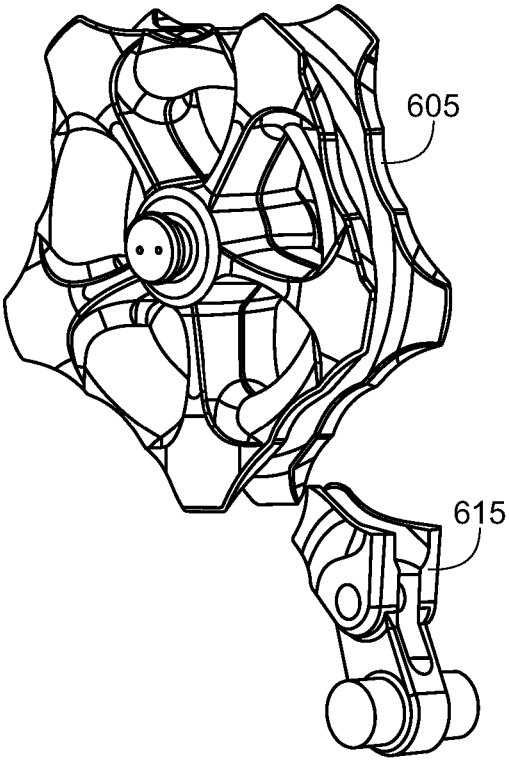
Figure 30A:
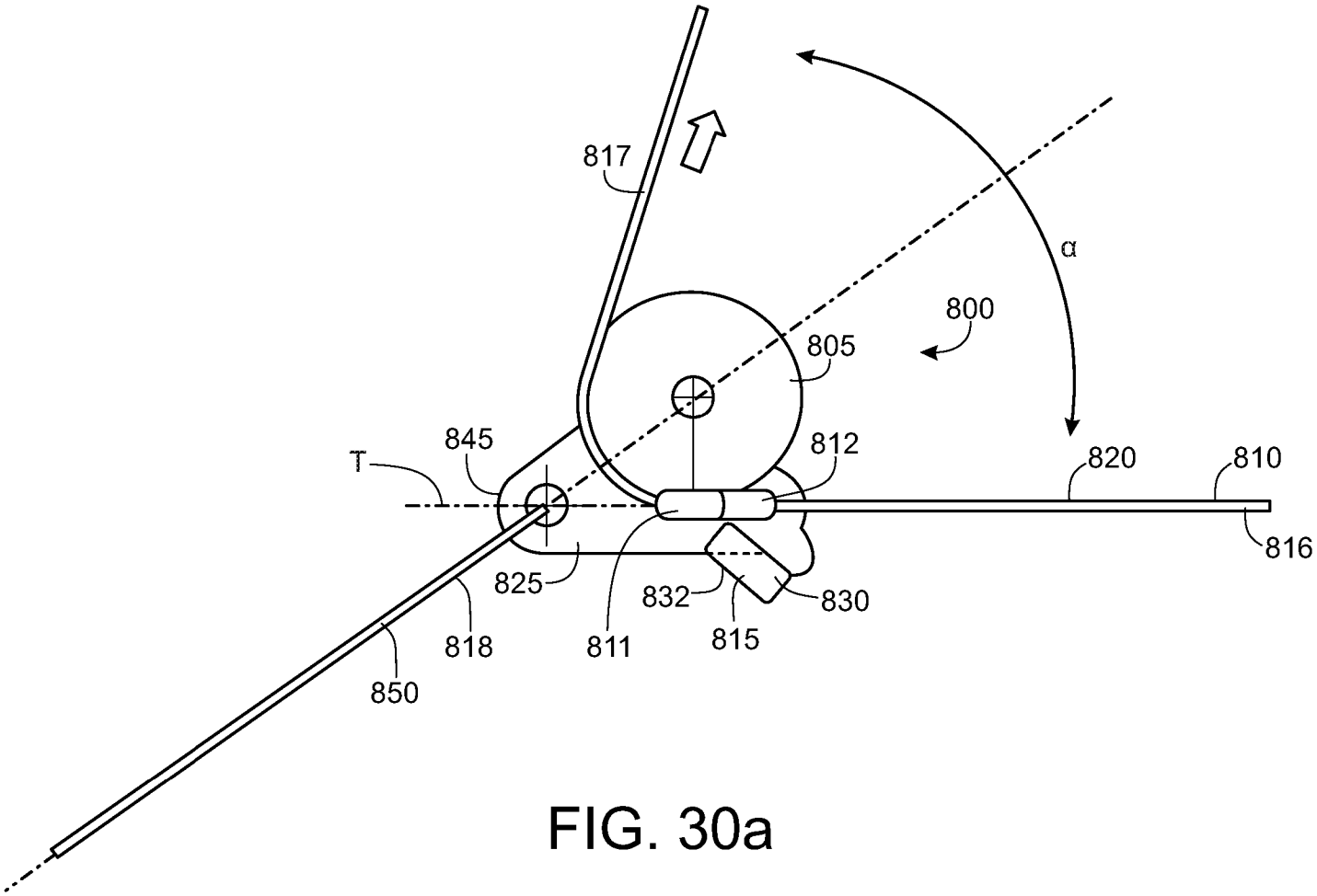
FIGS. 30(*a*) to (*d*) a series of schematic side views of a mooring apparatus corresponding to a number of the previously disclosed embodiments of the present invention.
Figure 30B:
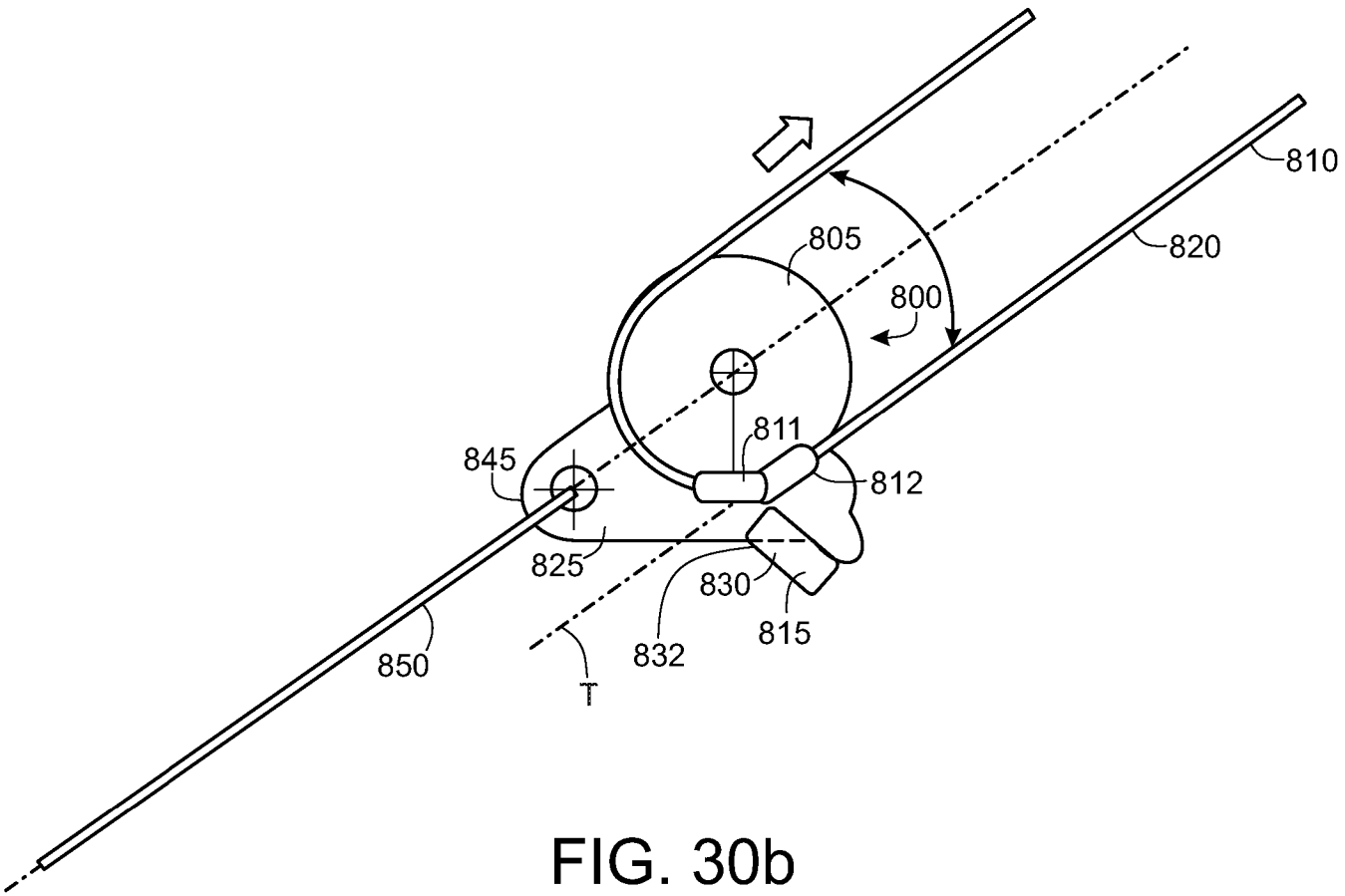
Figure 30C:
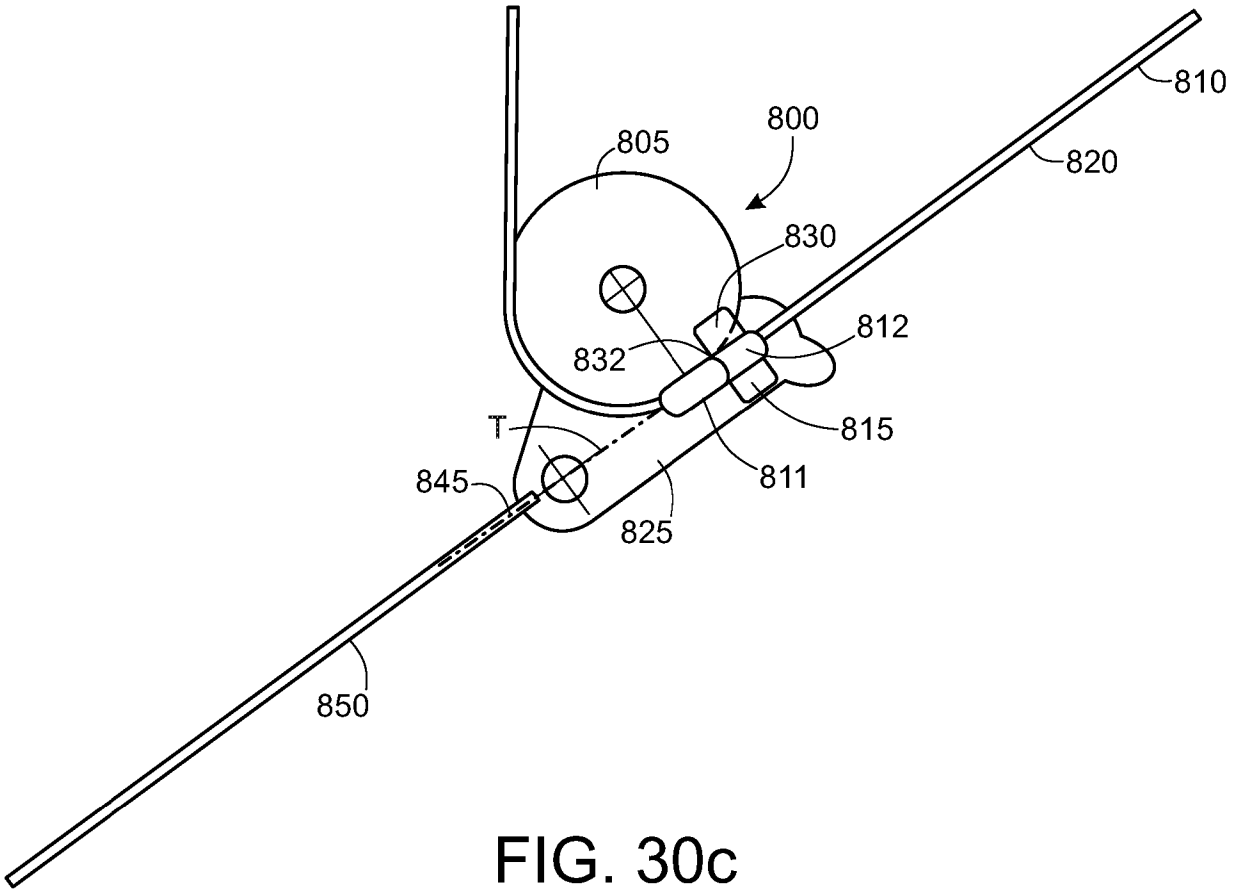
Figure 30D:
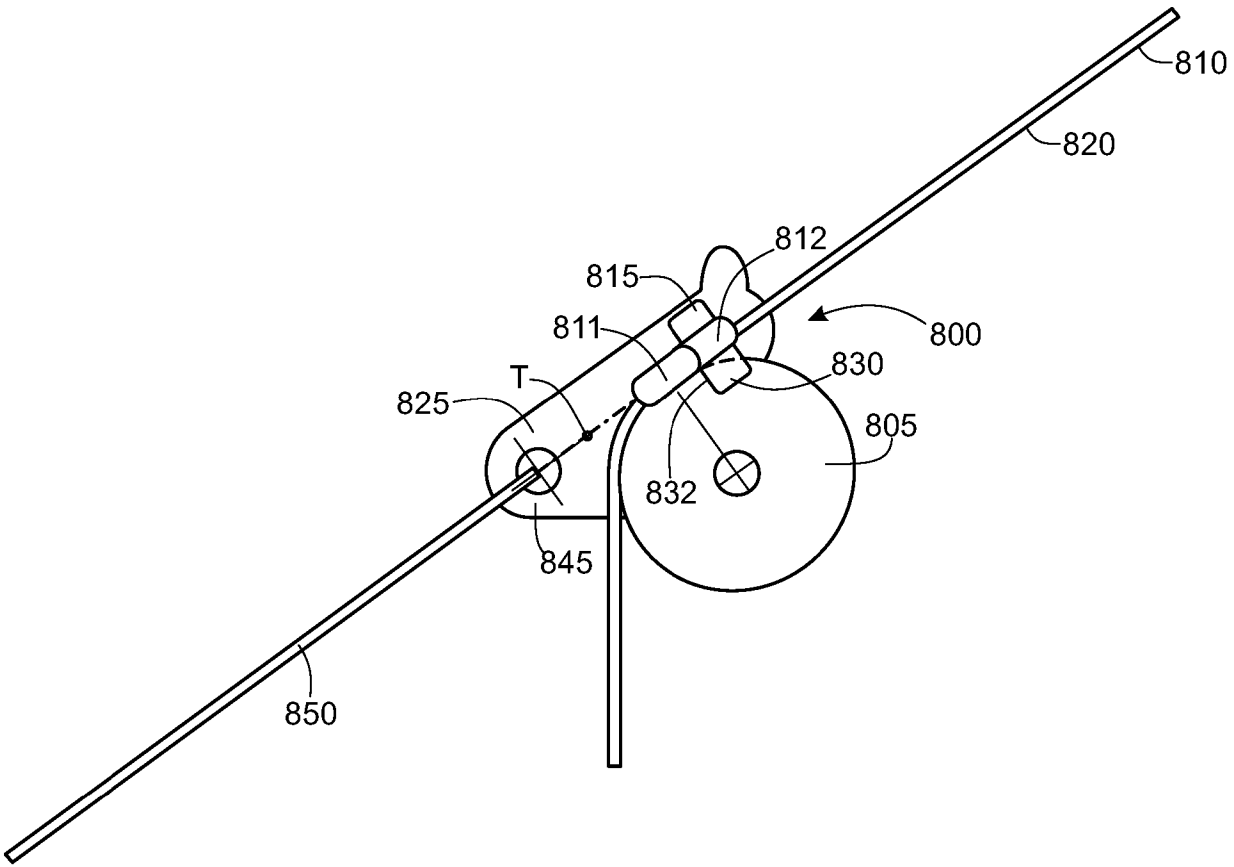
Figure 31A:
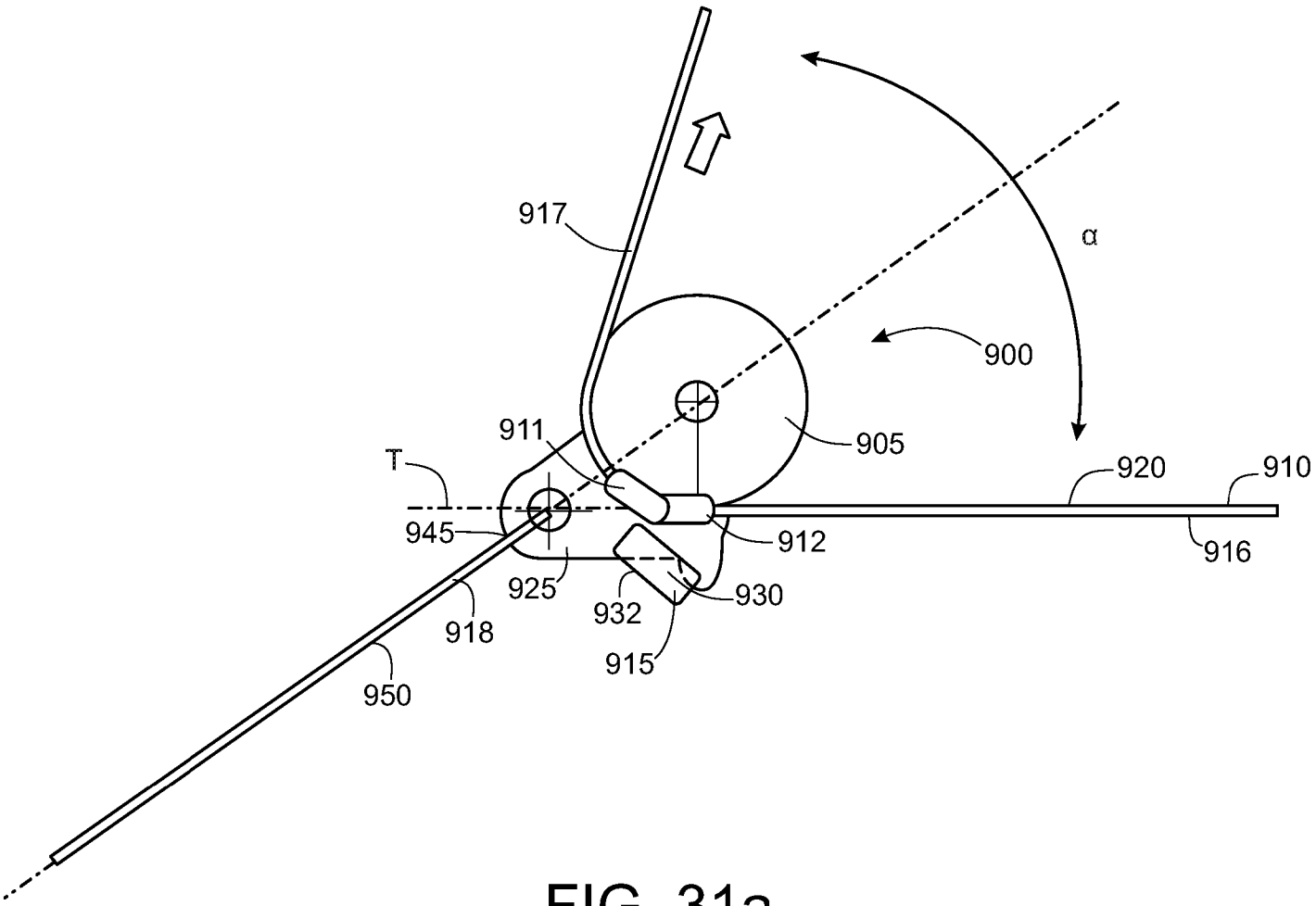
FIGS. 31(*a*) to (*d*) a series of schematic side views of a mooring apparatus corresponding to a number of the previously disclosed embodiments of the present invention.
Figure 31B:
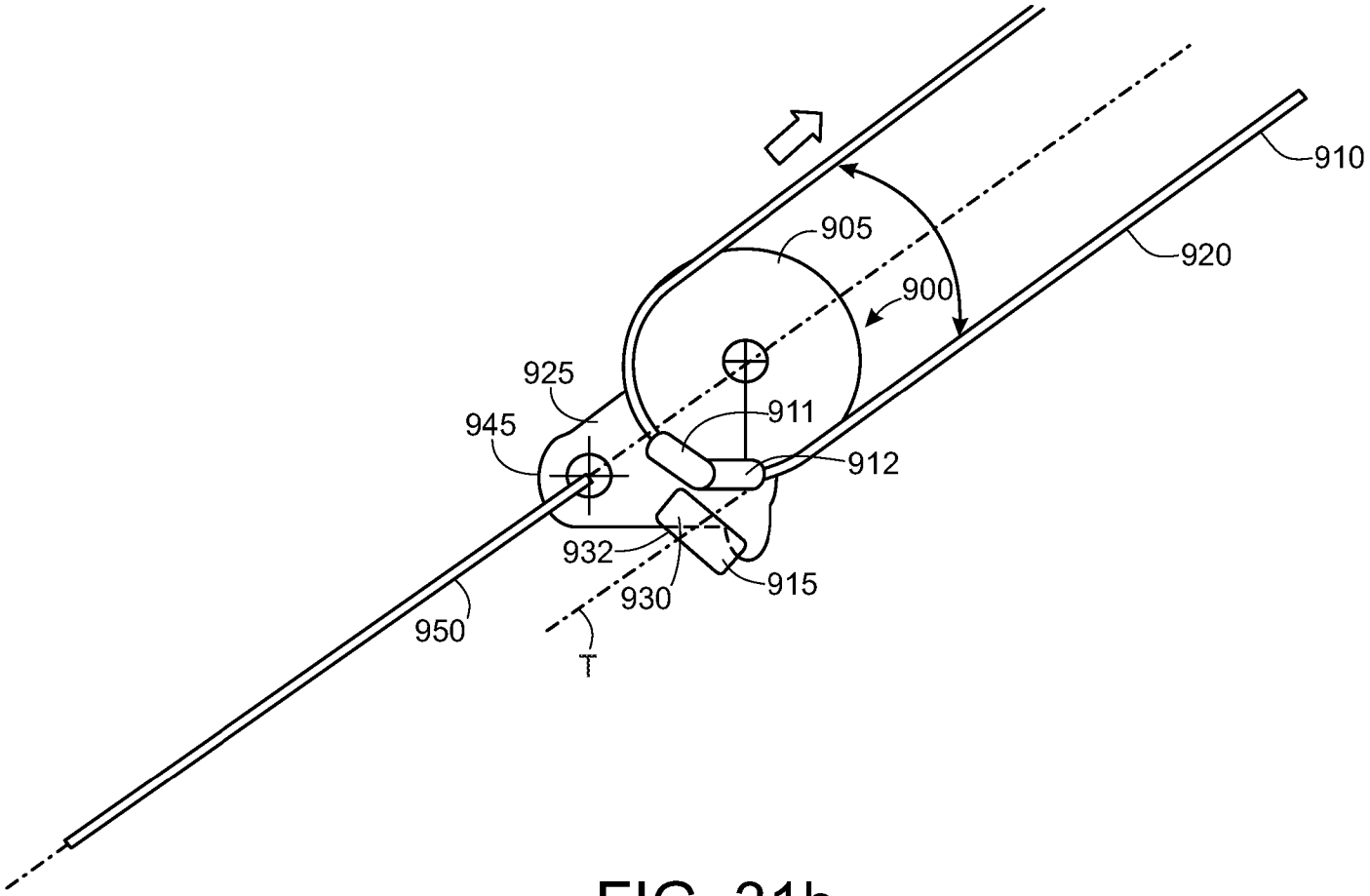
Figure 31C:
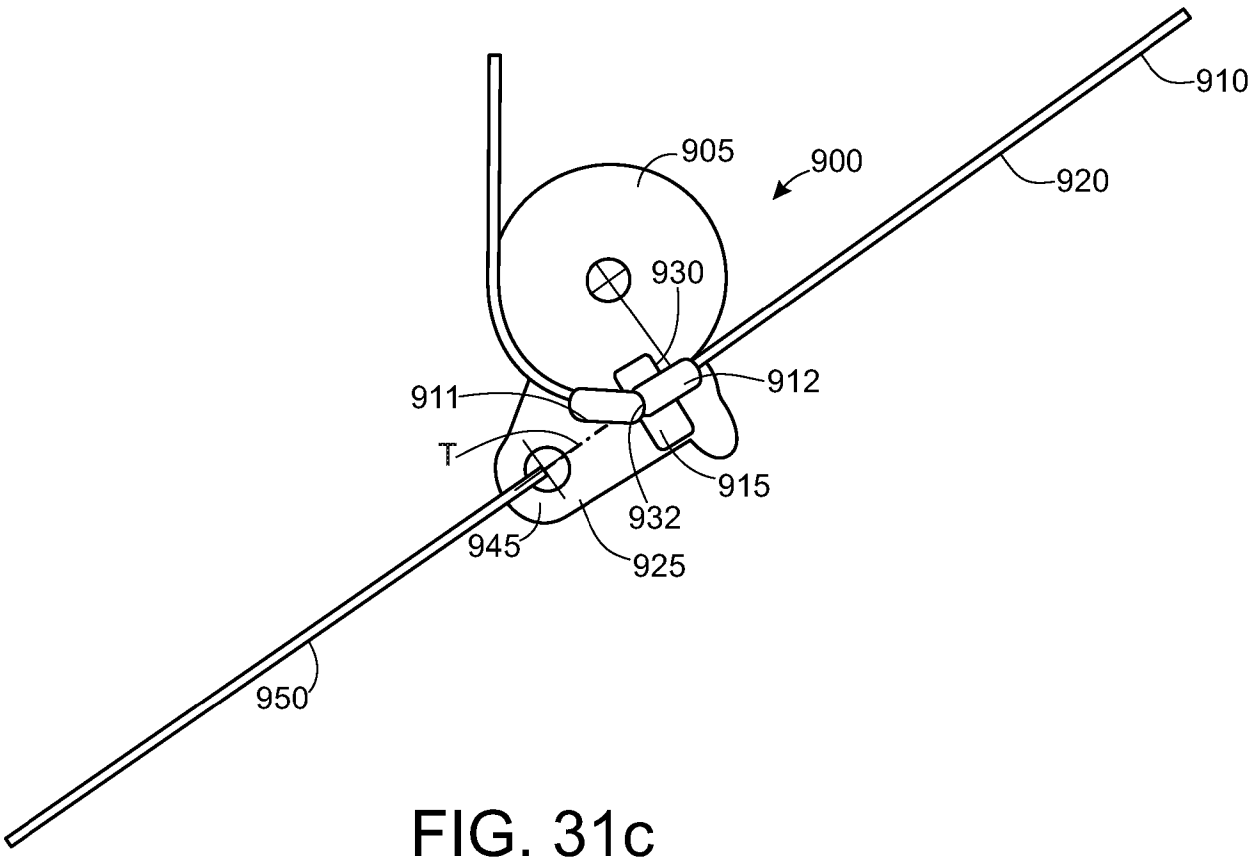
Figure 31D:
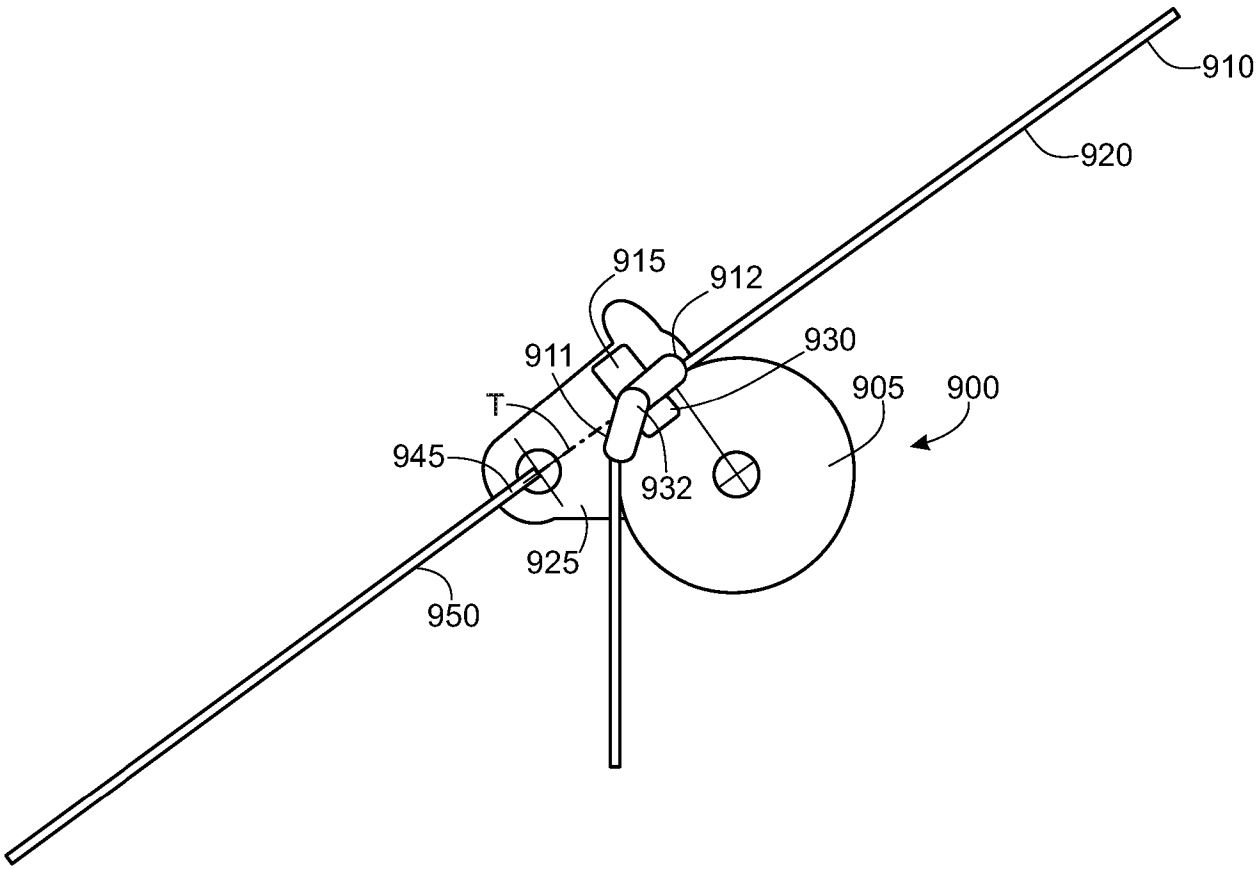

Referring to FIGS. 29(*a*) and (*b*) there are shown first and second combination of guide portions and lock members for use in embodiments of the present invention.

In the combination of FIG. 29(*a*), the guide portion comprises a spur/toothed wheel and the lock member comprises a yoke stopper which can mesh with the spurs/teeth of the spur/toothed wheel.

In the combination of FIG. 29(*b*), the guide portion comprises a groove wheel, i.e. a wheel having a circumferential groove and the lock member comprising a finger or pin type stopper which can mush with the circumferential groove. First and second outer members of the wheel are dispersed in parallel relation to one another and can comprise further teeth or spurs.

It will be appreciated that the guide portions, lock arrangement and counterweights showing in FIGS. 28(*a*) to (*d*) and FIGS. 29(*a*) and (*b*) can find utility in any embodiments of the present invention, e.g. the embodiments disclosed hereinbefore.

Referring to FIGS. 30(*a*) to (*d*), there is shown a series of schematic side views of an apparatus, generally described 800, according to the present invention. The mooring apparatus 800 is similar to mooring apparatus according to embodiments of the present invention hereinbefore disclosed.

The mooring apparatus 800 comprises a guide portion 805, a lock arrangement 815, a first mooring line path 820, a second mooring line path 821, and a tangent line T from the guide portion 805.

As can be seen in FIG. 30(*c*), in service, i.e. after tensioning of the first mooring line 810 and locking of the lock arrangement 815, the tangent line T aligns with a portion of the first mooring line path 820 extending upwards, i.e. to/from the structure to be moored and the second mooring line path 821 extending downwards, e.g. to an anchor point. Thus a continuous load path is provided.

Referring to FIGS. 31(*a*) to (*d*), there is shown a series of schematic side views of an apparatus, generally described 900. The apparatus 900 is similar to apparatus according to embodiments of the present invention, e.g. FIG. 26 hereinbefore disclosed.

The apparatus 900 is shown in FIGS. 31(*a*) to (*d*) in the same dispositions and acting in a similar way to the apparatus 800 as shown in FIGS. 30(*a*) to (*d*), respectively.

It will be noted that in the apparatus 800 of FIGS. 30(*a*) to (*d*), the locked link 811 and the first loaded link 812 are in the mooring line path 820 in service, i.e. when the first mooring line 810 has been tensioned. Also the locked link 811 is on the guide portion 805.

It will also be noted that in the apparatus 900 of FIGS. 31(*a*) to (*d*), only the first loaded link 912 is in the mooring line path 920 in service, i.e. when the first mooring line 910 has been tensioned. Also, the locked link 911 is on the guide portion 905.

It will be appreciated that the embodiments of the present invention hereinbefore described are given by way of example only, and are not meant to be limiting to the scope of the invention. Each of the disclosed embodiments provide the features recited in the statements of invention and in the appended claims, such not being recited herewith in full merely for reasons of brevity.

The invention claimed is:

1. An apparatus for mooring a structure and tensioning a mooring line, the apparatus comprising:

a body;

a guide portion for guiding a portion of a first mooring line or chain, the guide portion being rotationally mounted on the body;

a lock arrangement comprising a lock member;

the body comprising an arrangement for connecting the apparatus to a second mooring line; and the apparatus providing a first mooring line path, the lock member being provided on an opposite side of the first mooring line path from the guide portion when in an unlocked position, and the lock member being at least partially provided in or on the first mooring line path when in a locked position, wherein the lock arrangement comprises a counterweight, which is formed with, connected to, or releasably connectable to the lock member.

2. An apparatus as claimed in claim 1, wherein the apparatus is adapted such that, in use, when in a locked position a lock face of the lock member faces the arrangement for connecting the apparatus to the second mooring line.

3. An apparatus as claimed in claim 1, wherein in a locked position a tangent or tangential line of or extending from a portion of the guide portion passes through the lock member and the second mooring line connection arrangement.

4. An apparatus as claimed in claim 1, wherein a part or tangent point of the guide portion is provided between the second mooring line connection arrangement and the lock member when the lock member is in a locked position.

5. An apparatus as claimed in claim 1, wherein a radius of the guide portion extending perpendicularly to a line or tangent or tangential line extending between the second mooring line connection arrangement and the lock member, at least when in a locked position, intersects said line or tangent or tangential line, at a location between the second mooring line connection arrangement and the lock member.

6. An apparatus as claimed in claim 1, wherein the apparatus is adapted such that in a locked configuration:

a locked link and/or a first loaded link of a first mooring line or chain is/are provided or providable in a linear arrangement with the lock member, the second mooring line connection arrangement, and a/the tangential line from the guide portion; and/or a portion of the first mooring line or chain or first mooring line path, the body, and a second mooring line or second mooring line path provide a continuous, (linear mooring line or load path, and a/the locked link of a/the first mooring line is at least partially engaged with the guide, and at least a portion of the locked link is contiguous or coincident with the continuous mooring line or load path.

7. An apparatus as claimed in claim 1, wherein the guide portion and the lock member comprise a ratchet.

8. An apparatus as claimed in claim 1, wherein a pivot (point) of the lock arrangement or lock member is on an exterior angle of the first mooring line path and/or on an opposite side of the first mooring line path than the guide portion.

9. An apparatus or device for mooring a structure and/or tensioning a mooring line as claimed in claim 1, wherein the guide portion is provided on and/or within a first side or end of the body, and the lock arrangement is provided on and/or within a second side or end of the body, which second side or end may at least partly oppose the first side or end.

10. A system for tensioning a first mooring line, the system comprising at least one apparatus according to claim 1.

11. A method of tensioning a first mooring line, wherein the method comprises:

providing a system for tensioning a first mooring line according to claim 10, the method further comprising:

applying a pulling force to a first portion of a first mooring line in a direction away from the apparatus or device.

12. A method for releasing tension in a mooring line, the method comprising:

providing a system for tensioning a mooring line according to claim 10, the method further comprising:

applying a pulling force to a/the first portion of a/the first mooring line in a direction away from the apparatus or device;

releasing and/or retaining the lock arrangement in the unlocked position; and reducing and/or removing the pulling force.

13. An apparatus or device for mooring a structure as claimed in claim 1, wherein the apparatus or device provides a mooring line path having an included angle, the lock arrangement being provided on an opposite side of the mooring line path from the included angle and between the guide portion and a structure to be moored, in use.

14. An apparatus or device for mooring a structure and/or tensioning a mooring line as claimed in claim 1, wherein the body comprises an open channel for guiding and/or seating the first mooring line.

15. An apparatus or device for mooring a structure as claimed in claim 1, the apparatus or device comprising:

a connection portion for connecting the body to a second mooring line;

wherein the connection portion is disposed on the body such that, during tensioning of the mooring lines, the body tends to tilt or rotate to align a line between a center of the guide portion and the connection portion with the second mooring line.

16. An apparatus or device for mooring a structure as claimed in claim 1, the apparatus or device comprising:

the guide portion for guiding at least a portion of a first mooring line;

the lock arrangement adapted to engage the first mooring line;

wherein the guide portion is adapted to engage the first mooring line, and wherein the lock arrangement is configurable to straddle the guide portion and/or the first mooring line.

* * * * *